United States Patent [19]

Boser

[11] 3,994,246

[45] Nov. 30, 1976

[54] SEWING APPARATUS

[75] Inventor: Ronald J. Boser, Huntington Station, N.Y.

[73] Assignee: B & W Manufacturing Co., Inc., New York, N.Y.

[22] Filed: June 30, 1975

[21] Appl. No.: 591,948

Related U.S. Application Data

[62] Division of Ser. No. 402,876, Oct. 2, 1973, Pat. No. 3,893,402.

[52] U.S. Cl. ..... 112/121.12; 112/163; 112/136

[51] Int. Cl.[2] ..... D05B 21/00; D05B 1/08; D05B 35/00

[58] Field of Search ..... 112/104–107, 112/121.11, 121.12, 121.15, 163–167, 429, 432, 441, 262, 265, 136, 138, 143, 145, 147, 252

[56] References Cited

UNITED STATES PATENTS

| | | | |
|---|---|---|---|
| 2,329,991 | 9/1943 | Kellum | 112/136 |
| 2,776,635 | 1/1957 | Blamenkrantz | 112/105 |
| 2,977,904 | 4/1961 | Carmen | 112/105 |
| 3,158,118 | 11/1964 | Steingruber | 112/265 |
| 3,286,668 | 11/1966 | Rockerath et al. | 112/265 |

*Primary Examiner*—G. V. Larkin
*Attorney, Agent, or Firm*—Anthony A. O'Brien

[57] ABSTRACT

In an apparatus for sewing articles, such as sewing a slide fastener chain to an opening in an article, stitching of thread to an article is initiated by a manual control and is terminated by an automatic control in response to the sensing of a terminal point, such as the terminal point of an opening, on the article.

Article guiding facilities urge folded edge portions of an article toward each other by spring biased members on folding plates.

A scroll for receiving and guiding a folded edge portion of an article has an adjustable channel.

A linear motion apparatus, such as a dual needle holding mechanism, employs a linear motor driving a camming member which engages a locking member on a movable member to move the movable member to a selected position and to operate the locking member.

26 Claims, 63 Drawing Figures

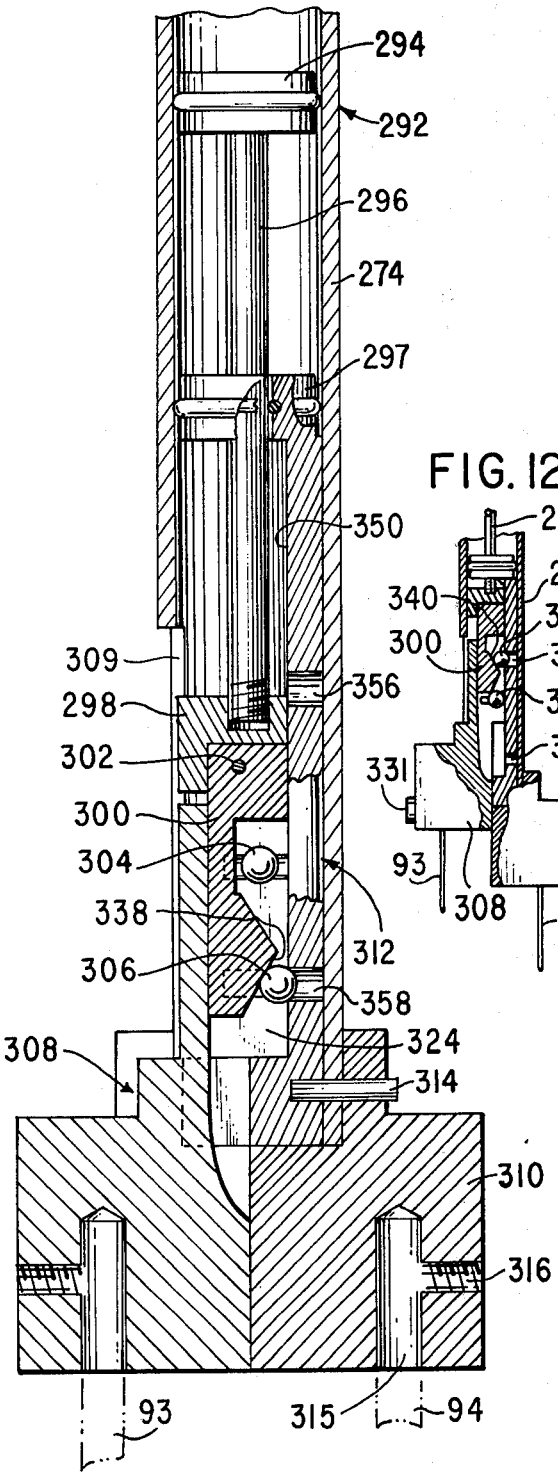
FIG. 11
FIG. 12
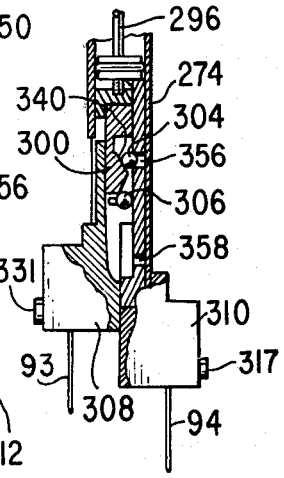
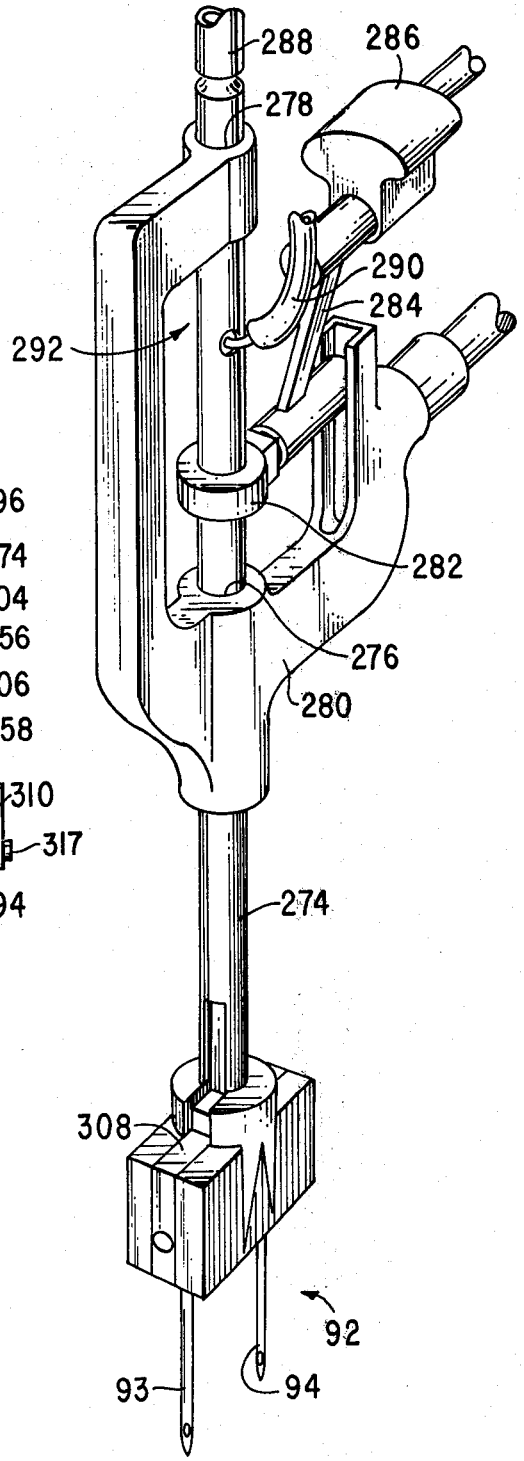
FIG. 10

640
642
1076
1106
BV
1108
906
1104
SW
1272
1270
1274
1242
1110
1244
1102
1058
1156
1112
1114
460
481
480
458
1136
1247
1246
1126
502
1150
1132
1138
207
205
1250
1130
500
1210
1140
208
1212
DELAY
1214
BV
1116
1126
1128
1204
1118
130
136
1122
1152
1206
892
SW
1120
924
1156
1202
SW
174
1200
1162
1166
1160
1208
1216
172
1182
1158
1172
1124
1184
1198
1170
1174
390
1256
1220
1222
1196
392
1186
1168
662
1246
1218
1183
1180
1176
666
1146
1194
1164
409
1142
1138
1190
1256
1188
DELAY
1192
1144
1246
1258
668
288
292
1178
664
1246
188
1256
290
186
1246
1260
1148
1154
1264
1262
1266
1298

1268
SW
934
1300
1238
SW
890

SEWING APPARATUS

CROSS REFERENCE TO RELATED APPLICATION

This is a divisional application of parent application Ser. No. 402,876 filed Oct. 2, 1973 now U.S. Pat. No. 3,893,402 dated July 8, 1975.

BACKGROUND OF THE INVENTION

1. Field of the Invention

This invention relates to apparatus for sewing and, in particular, to an apparatus for sewing slide fastener chain to openings of articles.

2. Description of the Prior Art

The prior art, as exemplified by U.S. Pat. Nos. 3,199,479, 3,200,779, 3,329,109, 3,359,931, 3,425,373, 3,442,236, 3,448,705, 3,536,020 3,570,434 and 3,705,446, includes many apparatus for sewing articles including apparatus for sewing slide fastener chain to openings in articles. Some prior art sewing apparatus is highly automated; however such automatic apparatus is usually limited to sewing a single line of stitches in a selected pattern and size on an article. Ribbon-like materials, such as slide fasteners, to be sewed on articles generally vary in length with each different article, making the prior art automatic apparatus impractical for sewing such ribbon-like materials to articles. Other prior art sewing apparatus utilize dual stitching facilities with dual needles to speed sewing of ribbon-like materials to articles; however such dual needle sewing machines generally require manual operations for functions other than forming stitches. Many prior art sewing apparatus employ article guiding facilities but such facilities are generally limited to single ranges of thicknesses of material. Also dual needle sewing machines having a retractable needle, such as Pfaff model No. 122, are available, but the mechanisms for retracting needles are generally complex and/or not adapted for automation; there is generally not available a linear motion apparatus which requires only a small moving force along a linear direction but remains rigid against a force many times as great as the moving force along the linear direction.

SUMMARY OF THE INVENTION

The invention is summarized in an apparatus for sewing a pair of tapes of a fastener chain to respective portions of an article having an opening between the portions which are joined at a terminal point at one end of the opening, the apparatus comprising a pair of means each including a needle for forming stitches from a respective thread, means for feeding the pair of tapes and the portions of the article through the pair of stitch forming means to form a pair of parallel spaced lines of stitches, each fastening a tape to a respective portion, manual control means for initiating operation of the pair of stitch forming means and the feeding means, means for sensing the terminal point of the opening, and automatic control means responsive to the sensing means for terminating the operation of the pair of stitch forming means and the feeding means.

An object of the invention is to provide automatic sewing apparatus for performing many sewing functions previously performed by manual operations.

Another object is to automatically terminate and form a bottom stop in sewing a slide fastener to an opening of an article.

It is an additional object of the invention to automate sewing of ribbon-like materials to articles by having an operator initiated cycle continue until a terminal point on an article is sensed to initiate an automatic termination cycle.

Still another object of the invention is to provide a linear motion mechanism, such as a needle retracting mechanism in a dual needle sewing apparatus, which requires a small moving force but locks in a selected position.

A further object of the invention is to provide an adjustable guiding mechanism for folded edge portions of articles to accommodate different thickness of material or the like.

Additional features of the invention include the provision of facilities for cutting a slide fastener chain in response to the sensing of a terminal point of an opening in an article; the provision of sewing machine thread cutter utilizing both sewing and shearing action on the thread; the provision of automatic thread tension release facilities in a sewing machine; the provision of facilities for moving the garment transverse to the normal direction of travel in a sewing machine in response to automatic control facilities; the provision of folding plates with spring biased seam closing members; the provision of a scroll member in a folder which has an adjustable concave channel; and the provision of facilities for feeding and guiding slide fastener chain to a sewing apparatus.

Other objects, features and advantages of the invention will become apparent from the following description of the preferred embodiments when taken together with the accompanying drawings.

BRIEF DESCRIPTION OF THE DRAWINGS

FIG. 10 is a perspective view of a dual needle mechanism of the apparatus of FIG. 1.

FIG. 11 is a cross section view from the front of a needle retracting and locking mechanism of the dual needle mechanism shown in FIG. 16.

FIG. 12 is a view similar to FIG. 11 but reduced in scale and with some portions broken away illustrating a left needle in a raised position.

DESCRIPTION OF THE PREFERRED EMBODIMENT

Figure 1:
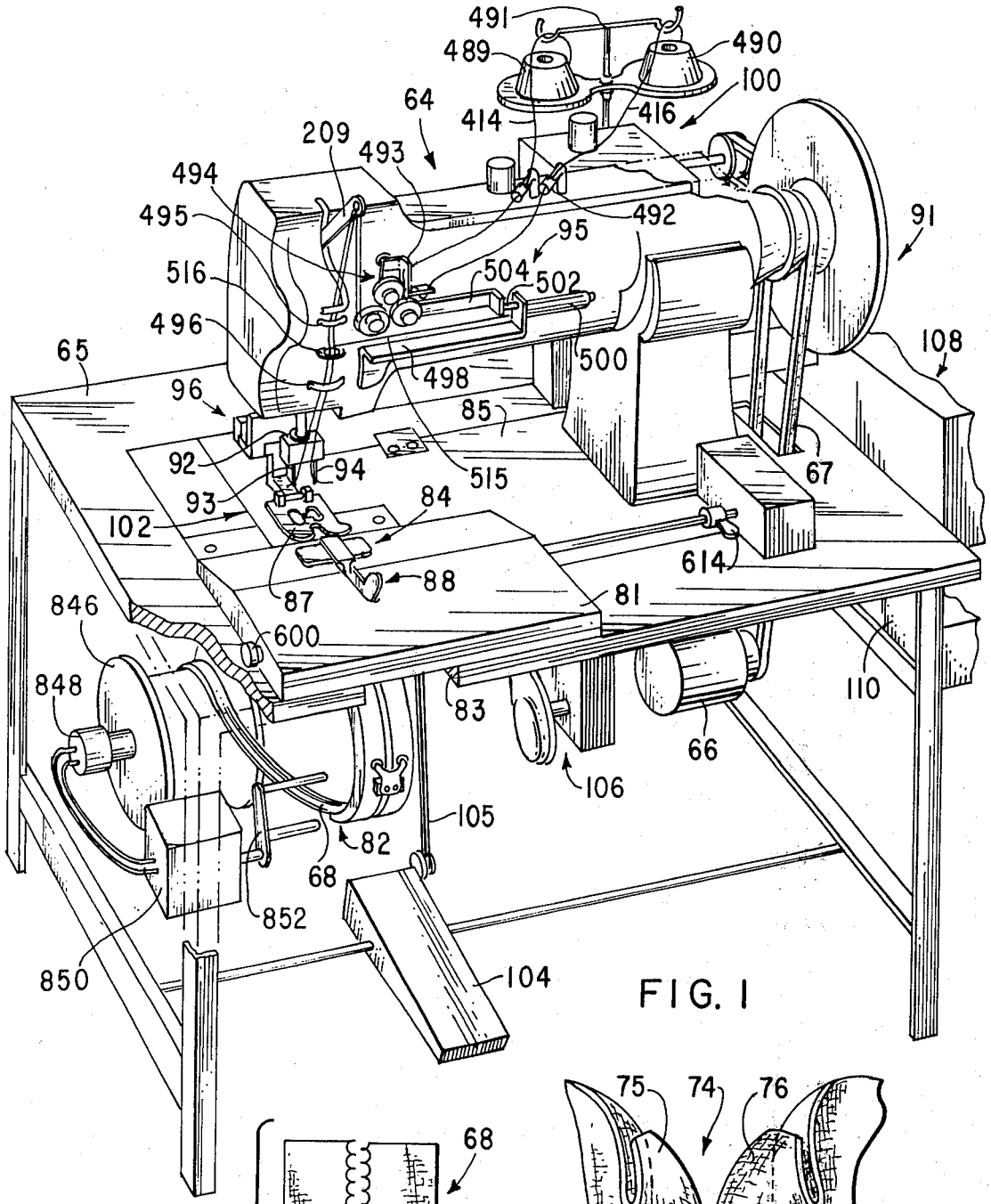
FIG. 1 is a perspective view with parts broken away of a sewing apparatus in accordance with the invention.
Figure 2:
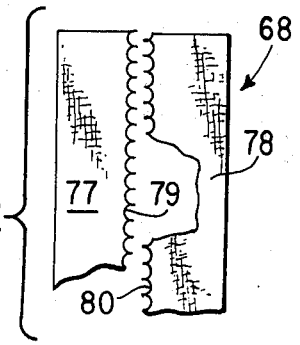
FIG. 2 is a plan view of a broken away portion of a slide fastener chain to be sewed to an article by the apparatus of FIG. 1.

As illustrated in FIG. 1, the invention is embodied in a sewing apparatus which includes a sewing machine indicated generally at 64, such as model 212 G 141 from the Singer Manufacturing Company, mounted on a table 65 and driven by a motor 66 through a V-belt 67. The sewing apparatus is designed to sew a section of a ribbon-like material, such as a fastener chain indicated generally at 68 in FIG. 2, to an article, such as a garment indicated generally at 69 in FIG. 3. The article 69 has two portions 70 and 71 which are joined at a seam 72 which terminates at point 73. Above the terminal point 73, the portions form a opening indicated generally at 74. Seam allowances 75 and 76 are folded back under the adjoining edges of the portions 70 and 71. The fastener chain 68 has cloth tapes 77 and 78 to which respective interlockng sets of fastener elements 79 and 80 ae secured. The cloth tapes 77 and 78 are to be sewn to the respective portions 70 and 71 on opposite sides of the opening 74.

Figure 4:
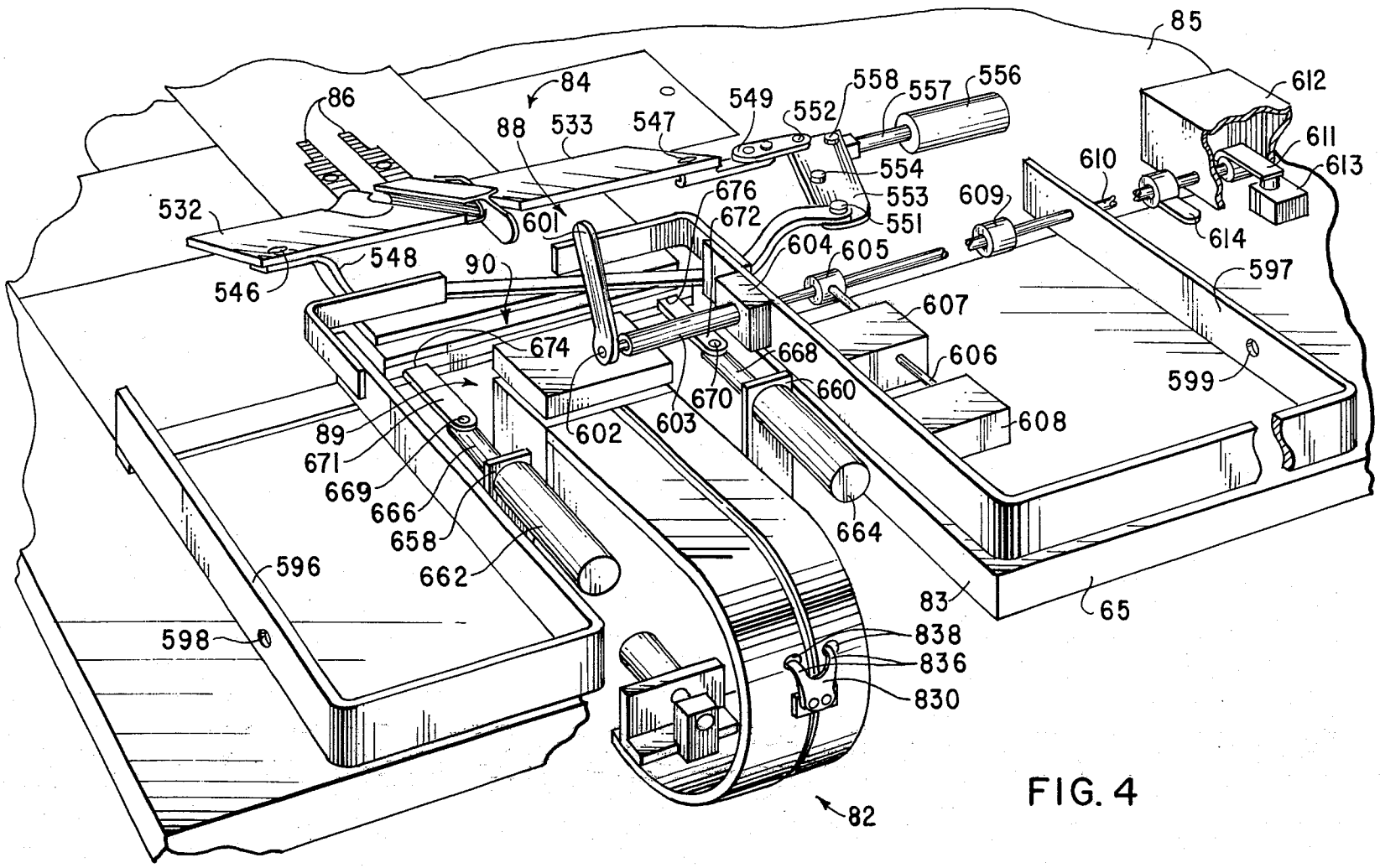
FIG. 4 is a perspective view of a front portion broken away from the apparatus of FIG. 1 with an article supporting cover removed.

A suitable cover 81 on the table 65 in front of the machine 64 has a smooth upper surface allowing the article to be easily fed to the machine. Below the cover, as shown in FIG. 4, a fastener-chain feeding and guiding mechanism, indicated generally at 82, is mounted below the top of the table 65 and curves upward into a recess 83 in the table 65. An article guide mechanism indicated generally at 84 is mounted above a base 85 of the sewing machine 64 in front of a feed dog 86 and a presser foot 87 (FIG. 1) of the sewing machine. A terminal point sensing mechanism indicated generally at 88 is mounted in front of the article guiding mechanism 84 while a fastener chain cutting mechanism indicated generally at 89 is mounted below the sensing mechanism 88 and in series with the end of the fastener chain feeding and guiding mechanism 82. A housing indicated generally at 90 below the article guiding mechanism 84 contains portions of a fastener chain end sensing and guiding mechanism and lower left and right thread cutting mechanisms.

Modifications to the sewing machine 64, as shown in FIG. 1, include a disc brake mechanism indicated generally at 91, a needle holding and retracting mechanism indicated generally at 92, supporting needles 93 and 94 such that the needle 93 is retractable, a thread tension release mechanism indicated generally at 95, and upper left and right thread cutting mechanisms indicated generally at 96. Additionally, transverse feed camming mechanism, indicated generally at 100, is mounted on the rear of the sewing machine 64 and is connected to a transverse feed mechanism indicated generally at 102. A manual control treadle 104 is pivotally mounted between the legs of the table 65 and pivotally joined to a connecting rod 105. A knee operated valve indicated generally at 106 is mounted below the front edge of the top of the table 65. An automatic control which includes both pneumatic and electrical control circuits is indicated generally at 108, on the right side of the table. A purchased motor control circuit unit 110 is also mounted on the right side of the table.

Figure 5:
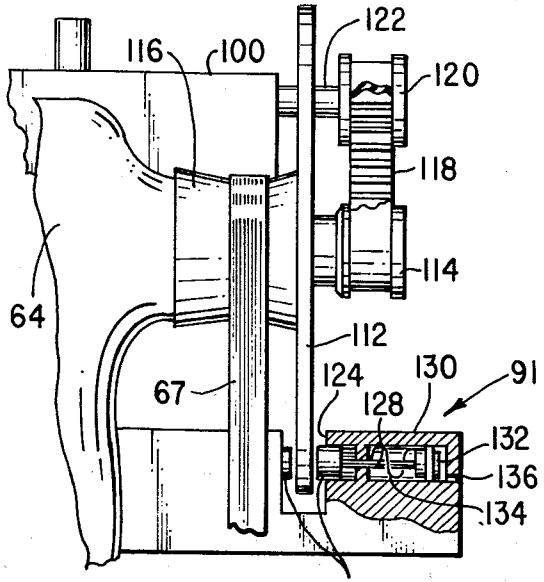
FIG. 5 is a front view of a braking mechanism partially in cross section and broken away from the apparatus of FIG. 1.

As illustrated in FIG. 5, a brake disc 112 and a cog pulley 114 are attached to a V-belt pulley 116 driven by the belt 67. A cog belt 118 connects the cog pulley 114 to a cog pulley 120 mounted on a shaft 122 of the camming mechanism 100. The cog pulley 116 and 120 are the same size to drive the shaft 122 in synchronism with the sewing machine 64. The brake mechanism 91 which is mounted on the sewing machine 64 has a groove 124 into which the brake disc 112 extends between a pair of brake shoes 126. At least one of the brake shoes is mounted upon a piston rod 128 extending from a cylinder 130 which contains a piston 132. A spring 134 biases the piston 132 and the brake shoes 126 away from the brake disc 144 while a passageway 136 is provided to the right end of cylinder 130 for supplying air to force the piston 132 and brake shoe 126 against the brake disc 112.

Figure 6:
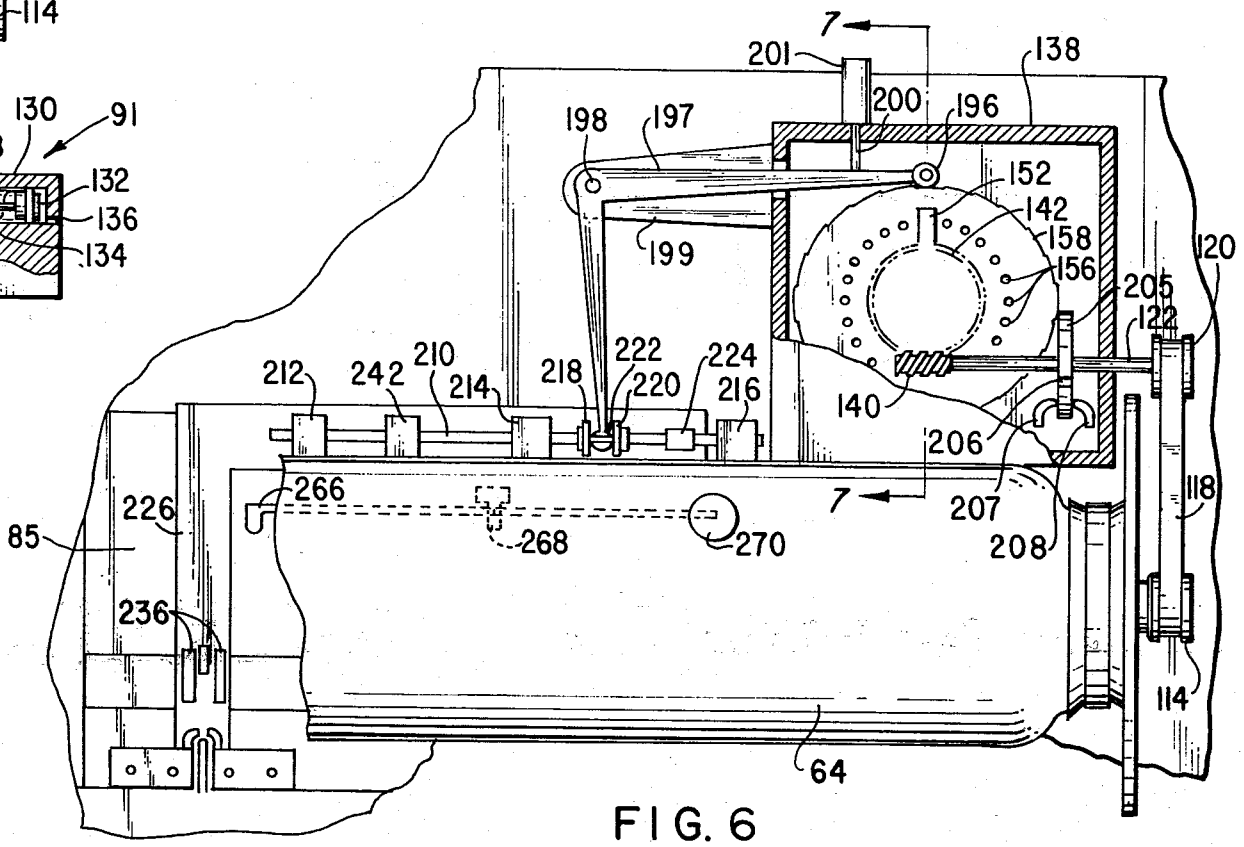
FIG. 6 is a top view partially in cross section including a transverse cam mechanism, a transverse article feed mechanism and presser foot lifting mechanism broken away from the apparatus of FIG. 1.
Figure 7:
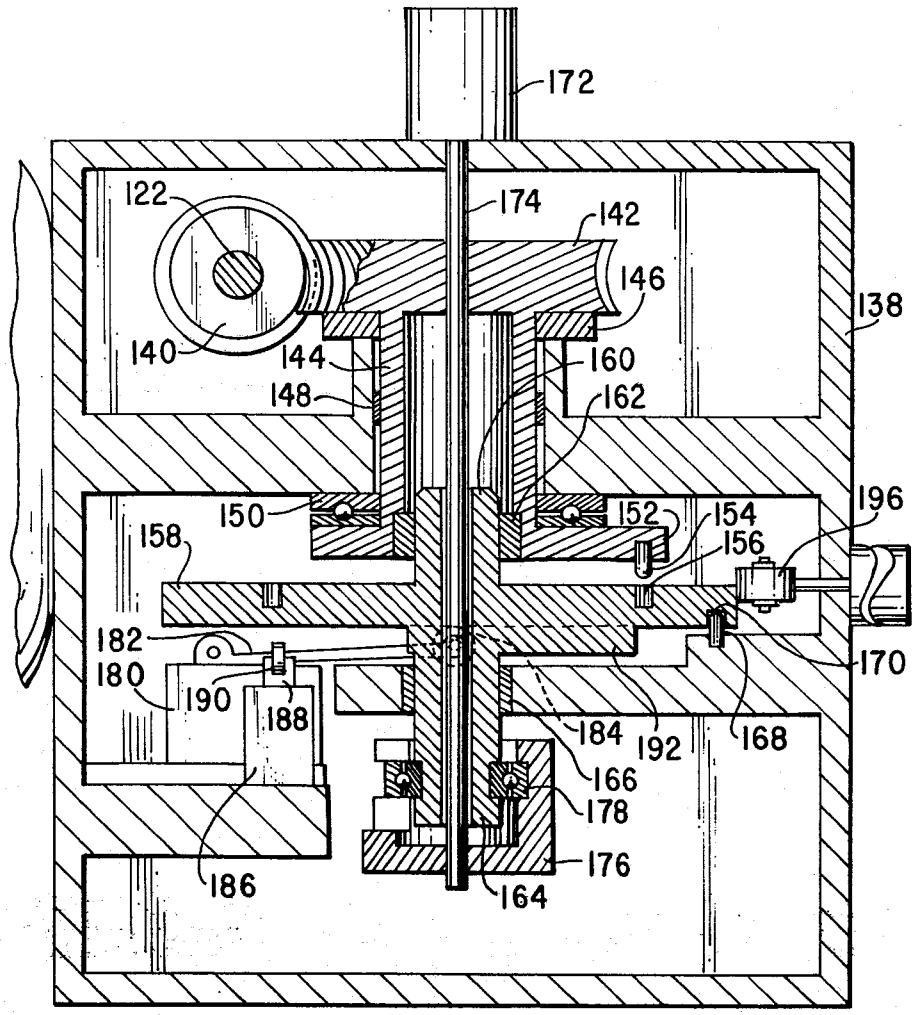
FIG. 7 is a cross section view from the right side along lines 7—7 of FIG. 6 of the transverse cam mechanism.

The transverse feed cam mechanism 100, as illustrated in FIGS. 6 and 7, includes a housing 138 in which the shaft 122 is suitably mounted for rotation. The shaft 122 has a worm screw 140 mating with a worm wheel 142 which is connected to a hollow shaft member 144 rotatably mounted by hearings 146, 148 and 150 within the housing 138. The lower end of the hollow shaft member 144 has a horizontally projecting portion 152 with an engaging member, such as pin 154, projecting from the lower surface thereof for engaging one of a plurality of engaging members, such as holes 156, on the upper surface of a cam 158. An upper journal portion 160 of the cam 158 is slidably and rotatably mounted by a bearing 162 within the hollow shaft member 144. A lower journal porton of 164 of the cam 158 is slidably and rotatably mounted by a bearing 166 within the housing 138. An engaging member, such as a pin 168, mounted on the housing 138 projects upward therefrom for engaging an engaging member, such as a hole 170, on the bottom of the cam 158. Alternately, teeth, lugs, etc. can be employed as engaging members 154, 156, 168 and 170. An air cylinder 172 has a piston rod 174 extending coaxially and slidably through the worm wheel 142, the hollow shaft 144 and the cam 158, and is secured to a clevis 176 which is vertically secured to a thrust bearing 178 on the lower journal portion 164 of the cam 158 for raising and lowering the cam 158.

Figure 8:
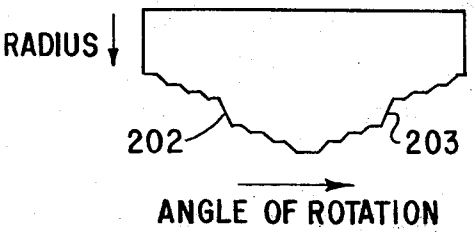
FIG. 8 is a diagram in linear form of the radius per angle of rotation from a stop position around to a next stop position of a cam of the transverse cam mechanism shown in FIGS. 6 and 7.

A valve 180 mounted in the housing 138 has a spring biased and pivoted arm 182 with a roller 184 engaging the under side near the outer edge of the cam 158 for operating when the cam 158 is raised and lowered. A valve 186 also mounted in the housing 138 has a spring biased operator member 188 with a roller 190 spaced such that the roller 190 is engaged by a lower cam projection 192 formed on the underside toward the center of the cam 158 at a specified angle of rotation of the cam 158. The outer periphery of the cam 158 is engaged by a cam follower 196 mounted on a lever 197 which is pivoted at a point 198 on a projection 199 of the housing 138. The lever 197 and cam follower 196 are biased against the cam 158 by a piston rod 200 extending from an air cylinder 201 mounted on the housing 138. The outer periphery of the cam 158 is machined so as to move the plate 226 and the presser foot 87 in steps or increments timed inbetween the period when the needles 93 and 94 are down to provide the desired transverse movement of the material in the sewing apparatus as illustrated in FIG. 8. Large steps 202 and 203 are formed to avoid the insertion of the right needle 94 in the area of the fastener elements 79 and 80 (FIG. 2) of the fastener chain 68. There is only one hole 170 and one projection 192 on the bottom of the cam 158 for each complete transverse cycle formed on the cam 158.

A top dead center sensing mechanism, as shown in FIG. 6, includes a position in disc 205 mounted on the shaft 122. The disc 205 has a radially formed slot 205 and is positioned between open aligned ends of the tube sections 207 and 208. The disc 205 has an angular alignment relative to the shaft 122 such that the slot 206 will be position between the open ends of the tube sections 207 and 208 when the needles 93 and 94 (FIG. 1) and a thread take up lever 209 (FIG. 1) are in their top dead center positions.

Figure 9:
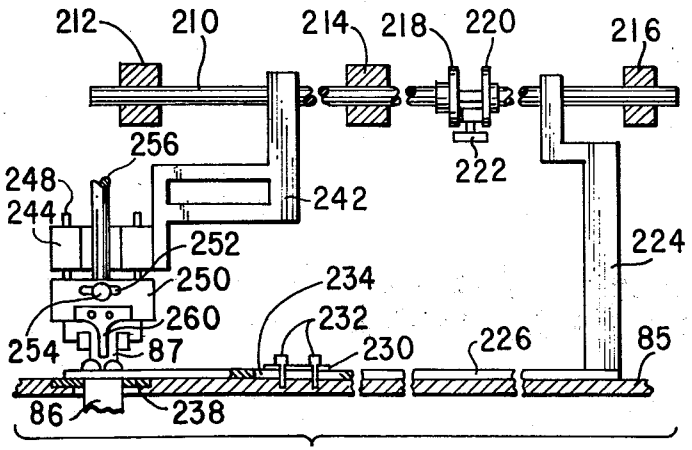
FIG. 9 is a front view of a broken away portion including a transverse article feed mchanism of the apparatus of FIG. 1.

The transverse feed mechanism 102, as illustrated in FIGS. 6 and 9, includes a shaft 210 slidable mounted in supports 212, 214 and 216 attached to the sewing machine. 64. A pair of flanges 218 and 220 mounted on the shaft 210 are engaged by a cam follower 222 on an end of the lever 197 between the flanges 218 and 220 for moving the shaft 210. A bracket 224 joins the shaft 210 to a transverse feed plate 226 which is slidably mounted on the base 85 of the sewing machine by a plate 230 secured to the base 85 by screws 232 through a slot 234 formed on the plate 226. The plate 226 extends over and has openings to 236 aligned with openings in a feed dog throat plate 238 and the feed dog 86 of the sewing machine 64.

Figure 16:
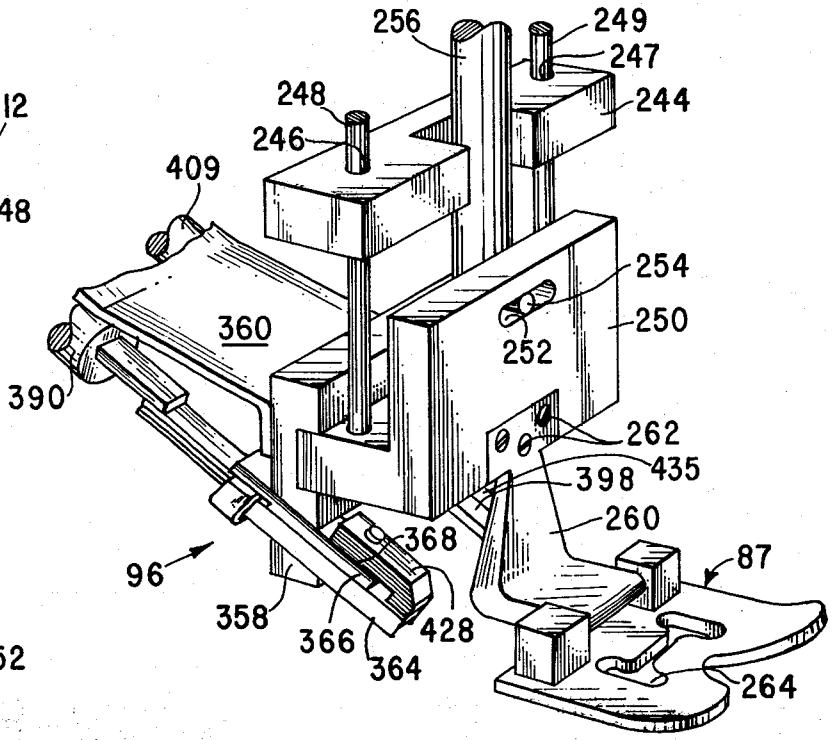
FIG. 16 is a perspective view of a presser foot support and upper left and right thread cutting and retaining mechanism broken away from the apparatus of FIG. 1.

A bracket 242 is secured to the shaft 210 and to a block 244 which, as shown in FIG. 16 has a pair of vertical bores 246 and 247 slidably receiving guide shafts 248 and 249 mounted on a foot support block 250. A horizontal slot 252 in the block 250 slidably receives a pin 254 secured to the end of a presser bar rod 256 of the sewing machine 64. The presser foot 87 is pivotally mounted on a bracket 260 which is secured by screws 262 to the foot support block 250. The presser foot 87 has an opening 264 to accommodate rocking movement of the needles 93 and 94 (FIG. 1) as well as transverse movement of the presser foot 87 with respect to the right needle 94 (FIG. 1).

Referring to FIG. 6, a presser bar lifting lever 266 which is pivoted at point 268 within the machine 64 is connected to a piston rod 271 (FIG. 52) extending from a presser foot lift air cylinder 270 mounted on top of the sewing machine 64. The piston rod 271 is normally spring biased to a retracted position until air pressure is applied to the air cyliner 270. The lever 266 engages the presser bar 256 (FIG. 16) which is spring biased downward, the engagement and biasing (both not shown) being in a conventional manner.

The needle holding and retracting mechanism 92, as illustrated in FIG. 10, has a tubular needle bar 274 which slidably extends through the vertical bores 276 and 278 of a needle bar rocker rame 280 which is mounted for oscillation through an angle in a conventional manner. A needle bar connecting stud 282 mounted on the tubular needle bar 274 is pivotally connected to one end of a needle bar connecting link 284 which is pivotally connected at its other end to a needle bar crank 286 which is rotatably mounted in a conventional manner in the sewing machine 64 (FIG. 1). Air hoses or conduits 288 and 290 are suitably connected in communication with a linear reciprocal motor or an air cylinder portion, indicated generally at 292, of the tubular shaft 274. As shown in FIGS. 11 and 12, an air piston 294 slidably mounted within the cylinder portion 292 has a piston rod 296 extending through a dividing seal portion 297 and threaded at its lower end to a coupling member 298 which has a cam 300 secured thereto by a pin 302. The cam 300 selectively engages movable locking elements or members, such as steel balls 304 and 306, slidably mounted within a retractable needle holder indicated generally at which is slidable within a verticle slot 309 in the tubular bar 274. A non-retractable needle holder 310 and a detent bar, indicated generally at 312, are secured to the lower end of the tubular shaft 274 by a pin 314. The non-retractable needle holder 310 has a suitable needle receiving cavity 315 extending vertically from the bottom of the holder 310 which also has a threaded bore 316 with a set screw 317 (FIG. 12), retaining the needle 94 in the cavity 315.

Figure 13:
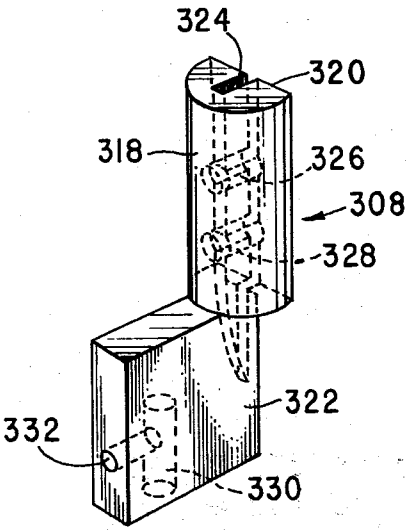
FIG. 13 is a perspective view of a retractable needle holder of the needle retracting mechanism of FIGS. 11 and 12.

As shown in FIG. 13, the retractable needle holder 308 has a cylindrical section 318 sectioned longitudinally to form a flat 320, and a lower plate like portion 322. A vertically extending groove or slot 324 is formed from the flat 320 into the cylindrical portion 318 and extending into the plate like portion 322. Horizontal recesses or bores 326 and 328 having diameters larger than the width of the slot 324 are formed from the flat 320 into the cylindrical portion 318 with the slot 324 bisecting the bores such that horizontal grooves are formed in the walls of the slot 324 to slidably receive and vertically retain the steel balls 304 and 306 (FIG. 11). A suitable needle receiving cavity 330 extends from the bottom edge of the plate member 322 and a threaded bore 332 extends from the edge of the plate member into the cavity 330 for receiving a set screw 331 (FIG. 12) to retain the needle 93 in the retractable needle holder 308.

Figure 14:
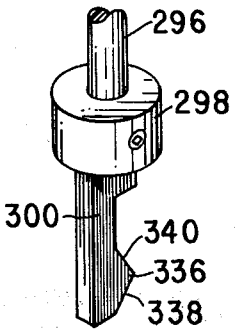
FIG. 14 is a perspective view of a cam of the needle retracting mechanism of FIGS. 11 and 12.

The cam 300, as illustrated in FIG. 14, has a generally flat configuration designed to slide within the slot 324 of the retractable needle holder 308 of FIGS. 11 and 13. The cam 300 has a V-shaped cam portion 336 which has a lower sloping face 338 for engaging the ball 306 (FIG. 11) to urge the steel ball 306 downward and outward in the bore 328, when the piston 294 is urged downward. Similarly, an upper sloping face 340 of the V-shaped portion 336 is such that it engages the steel ball 304 to urge the steel ball 304 upward and outward when the piston 294 is urged upward.

Figure 15:
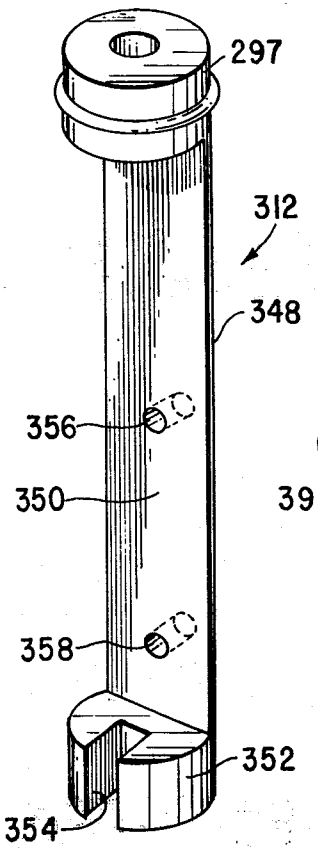
FIG. 15 is a perspective view of a detent bar of the needle retracting mechanism of FIGS. 11 and 12.

The detent bar 312, shown in detail in FIG. 15 includes the dividing seal portion 297, a central portion 348 sectioned longitudinally from a cylinder to form a flat 350 which mates with the flat 320 (FIG. 13) of the retractable needle holder 308, and a lower cylindrial portion 352 having a slot 354 for receiving the plate like portion 322 (FIG. 13) of the retractable needle holder 308. Recesses or bores 356 and 358 are formed horizontally in the central portion 348 from the flat 350 and have diameters which are sufficiently smaller than the diameters of the respective balls 304 and 306 (FIG. 11) and the bores 326 and 328 (FIG. 13) such that rounded right end portions of the balls 304 and 306 will protrude into the respective bores 356 and 358 and engage the opening edges of the bores 356 and 358 at an angle inclined to the axis of the tubular bar 274.

As illustrated in FIG. 11 and 12, the horizontal projecting width of the camming portion 338, the horizontal depth of the slot 324 and the diameter of the steel balls 304 and 306 are selected such that the steel balls 304 and 306 will retain the cam 300 in the slot 324 when the cam is moved upward with the steel balls 304 and 306 slidingly engaging the flat 350 inbetween the bores 356 and 358.

Figure 17:
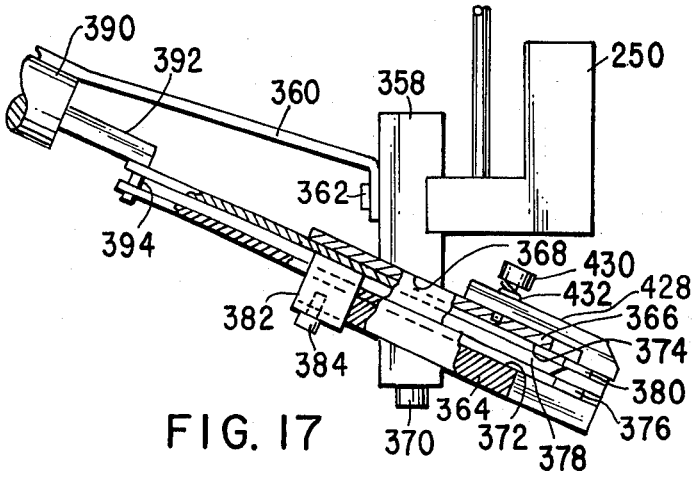
FIG. 17 is a side view partially in cross section of a portion of the upper left thread cutting and retaining mechanism shown in FIG. 16 in a first position.
Figure 18:
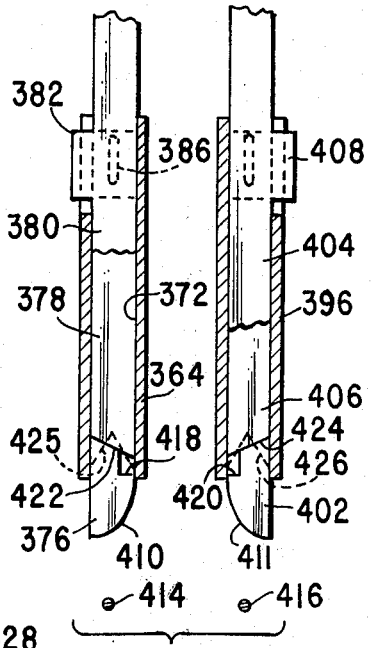
FIG. 18 is a plan view of broken away portions of the upper left and right thread cutting mechanisms shown in FIG. 16 in second positions.

The upper left and right cutting mechanisms 96 are illustrated in FIGS. 16, 17, 18, 19, 20 and 21, and referring first to FIGS. 16 and 17, have a supporting member 358 and a supporting plate 360 secured to the rear of the foot support block 250 by screws 362. A left upper thread cutter has a lower support and guide member 364 and an upper support and guide member 366 secured within a slot 368 of the supporting member 358 by a set screw 370. The lower support and guide member 364 has a channel 372 which mates with a channel 374 in the upper support guide member for enclosing a lower snagging blade 376, a cutting blade 378 and an upper snagging blade 380. The cutting blade 378 has a wing portion 382 which extends through appropriate machined portions of the upper and lower members 364 and 366 around to the bottom of the lower member 365 where a screw 384 in a longitudinal slot 386 (FIG. 18) of the wing portion 382 secures the blade 378 to the lower guide member 364. An air cylinder 390 is suitably secured to the mounting plate 360 and has a piston rod 392 and a pin 394 secured to the rear ends of the snagging blades 376 and 380. As shown in FIG. 18 the right thread cutter has a lower support and guide member 396 and an upper support and guide member 398 (FIG. 16) for enclosing a lower snagging blade 402 and an upper snagging blade 404 with a cutting blade 406 sandwiched between the snagging blades 402 and 404. A wing portion 408 of the cutting blade 406 is secured to the lower guide member 396 in a manner similar to the wing portion 382 of the cutting blade 378. An air cylinder 409 (FIG. 16) has a piston rod (not shown) attached to the rear ends of the snagging blades 402 and 404 in a manner similar to the piston rod 392 of air cylinder 390 and snagging blades 376 and 380.

Figure 19:
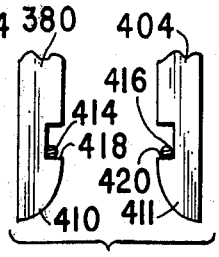
FIG. 19 is a plan view of a broken away portion of upper left and right needle snagging blades of the thread cutting mechanism shown in FIGS. 16 and 18 in third positions.

Referring to FIGS. 18 and 19, the left pair of snagging blades 376 and 380 and the right pair of snagging blades 402 and 404 have respective curved camming edges 410 and 411 which are designd to cam respective upper threads 414 and 416 toward each other as the blades are moved into engagement with the threads 414 and 416. Hook portions 418 and 420 are formed in the respective pairs of snagging blades 376, 380, 402 and 404 such that the threads 414 and 416 are snagged or hooked upon the advancement of the snagging blades. Knive or severing edges 422 and 424 of the cutting blade 378 and 406 are formed on the forward edges of the cutting blades 378 and 406 and extend at an angle to the direction of movement of the snagging blades 376 and 380, 402 and 404 such that camming forces are applied to the threads 414 and 416 by the severing edges 422 and 424 to maintain the threads 414 and 416 within the hook portions 418 and 420 while the threads are dragged or drawn along the severing edges 422 and 424. The knife edges 422 and 424 are formed such that they cut the threads 414 and 416 by a shearing action (see FIG. 20) between the knife edges 422 and 424 and the hook portions 418 and 420 of the upper snagging blades 380 and 404 as well as a scraping or tearing action of the threads 414 and 416 as the hook portions 418 and 420 retract to a position back of the severing edges 422 and 424. V-shaped grooves 425 and 426 are formed in the forward ends of the respective lower support members 364 and 396 below the hook portions 418 and 420 to allow the severed ends of the threads extending from the article to fall freely from the upper thread cutting mechanisms.

As illustrated in FIGS. 16, 17, 20, and 21, a thread retaining element 428 is movably mounted on the upper guide member 366 by a screw 430 and a spring 432 which is disposed between the head of the screw 430 and the upper surface of the thread retaining element 428. A forward portion 434 of the thread retaining element 428 extends forward and downward from the forward edge of the upper guide member 366 and is biased by the spring 432 into engagement with the upper thread snagging blade 380 such that the severed end of the thread 414 extending from the left needle 93 (FIG. 1) is gripped or retained between the element 420 and the snagging blade 380. A similar thread retaining element 435, screw and spring (not shown) are secured to the upper guide member 398 of the right upper thread cutter for gripping the severed end of the thread 416 from the right needle 94 (FIG. 1). The thread retaining elements are designed to retain the threads extending from the needles 93 and 94 with retaining force sufficiently great that movement of the needles does not pull the thread out of the thread retaining elements until again stitched to an article.

Figure 22:
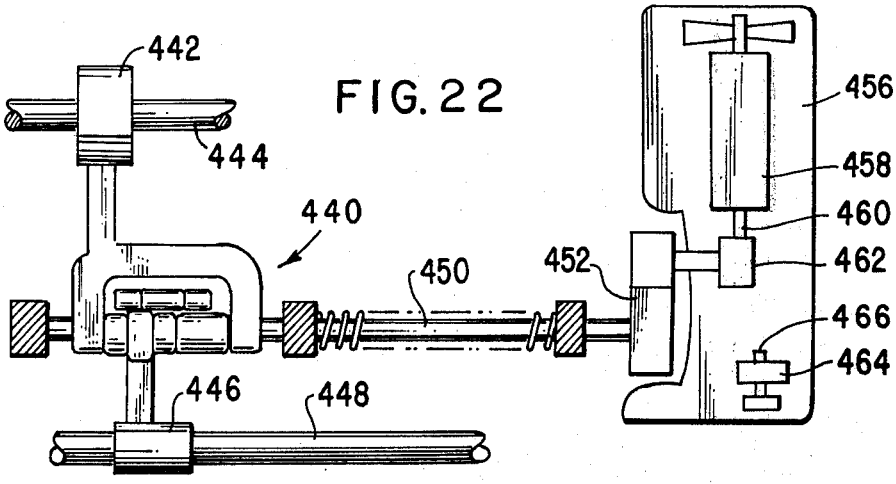
FIG. 22 is a top view of a zero rocking feed motion mechanism broken away from the sewing apparatus of FIG. 1.

FIG. 22 shows a modification which is made to the normal feed reversing mechanism for the rocking feed movement of the feed dog 86 (FIG. 4) and the needles 93 and 94 (FIG. 1). The reversing mechanism indicated generally at 440 is part of the purchased sewing machine and through appropriate toggle linkage (not herein described) connects a feed driving eccenric 442 operated by a bobbin or hook driving shaft 444 to a feed driving rock shaft crank arm 446 attached to a feed driving rock shaft 448 to produce oscillating motion of the shaft 448 and simultaneous rocking feed movement of the needles and feed dog. The reversing mechanism 440 has a feed reversing shaft 450 to which an arm 452 is attached for rotation between a forward feed position and a reverse feed position. The modification includes a plate 456 suitably attached to the underside of base 85 of the sewing machine with an air cylinder 458 pivotally attached to the plate 456. A piston rod 460 extending from the air cylinder 458 is pivotally attached by a pivot 462 to the arm 452 for rotating the arm 452. A bracket 464 mounted on the plate 456 has an adjustable bolt or threaded stop member 466 aligned for being engaged by pivot 462 to determine the length of advancement of the piston rod 460. The position of the stop member 466 is selected to produce a zero feed rate for the feed dogs and needle when the air piston rod 460 is advanced. The attachment to the arm 452 is made such that, when the piston 460 is retracted, an article is fed by rocking movement of the feed dog 86 and needles 93 and 94 in a forward direction from the front to the rear of the sewing machine by the oscillating movement of the feed driving rock shaft 448.

Figure 23:
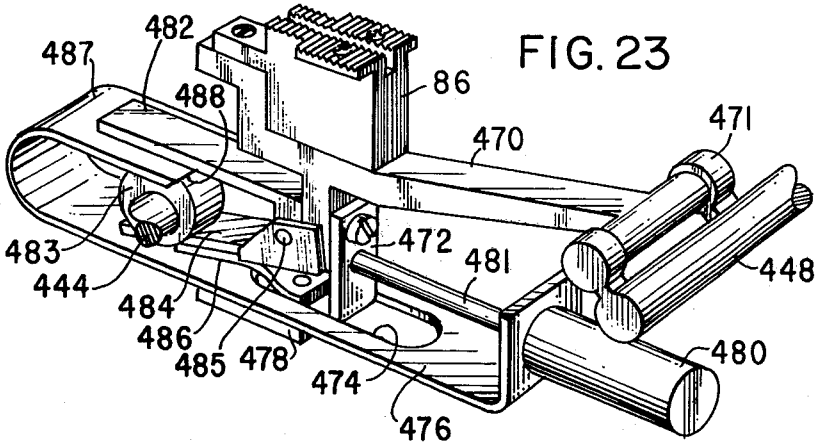
FIG. 23 is a perspective view of a feed dog dropping mechanism broken away from the apparatus of FIG. 1 in a first position.
Figure 24:
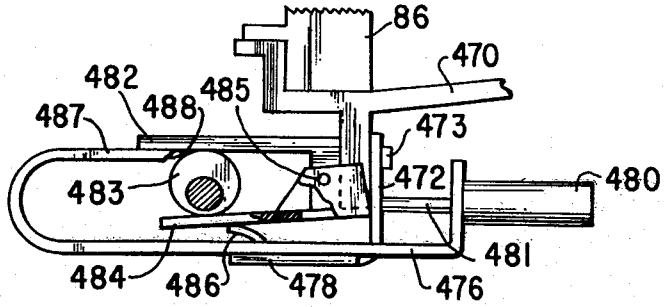
FIG. 24 is a side view of the feed dog dropping mechanism of FIG. 23 in a second position.

A mechanism for dropping the feed dog 86 out of engagement with the material is illustrated in FIGS. 23 and 24. The feed dog 86 is mounted on a feed bar coupling or frame 470 which is pivotally connected to a crank portion 471 of the feed driving rock shaft 448. A bracket 472 mounted on the feed frame 470 by a screw 473 extends downward through a slotted opening 474 in a drop feed follower insert 476 and has an enlarged lower portion 478 which slidably supports the follower insert 476. A feed dog dropping air cylinder 480 is mounted on the drop feed follower insert and has a piston rod 481 which is secured to the bracket 472 for moving the drop feed follower insert 476. A drop feed cam follower 482 mounted on the feed frame 470 extends above a feed lifting eccentric or cam 483 which is mounted on the book driving shaft 444 while a drop feed spring plate 484 pivotally mounted on the cam follower 482 by a pin 485 is biased by a spring 486 mounted on the bottom portion 478 of the bracket 472 against the bottom of the cam 483. The drop feed follower insert 476 has a return portion 487 which is curved upward and backwardly below the drop feed cam follower 482 and has an inclined end 488 which allows insertion of the return portion 487 between the drip feed cam follower 482 and the cam 483 when the piston rod 481 is advanced relative to the air cylinder 480 and withdrawal of the return portion 487 from between the drop feed cam follower 482 and the cam 483 when the piston rod 481 is retracted relative to the air cylinder 480. The return portion 487 has a thickness designed to raise the feed dog 86 to a position where it can engage and advance an article beneath the presser foot 87 when the return portion 487 is inserted and to allow the feed dog 86 to drop to a position where it will not engage an article when the return portion 487 is withdrawn.

Figure 25:
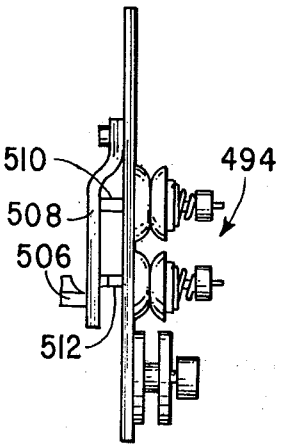
FIG. 25 is a side view of a thread tension releasing mechanism broken away from the apparatus of FIG. 1.

Referring to FIG. 1, the upper threads 414 and 416 extend from respective bobbins 489 and 490 on a stand 491 mounted on the rear of the table 65 through guides 492 and 493, a thread tension mechanism indicated generally at 494, the thread take up lever 209, guides 495 and 496 to the needles 93 and 94. The thread tension release mechanism 494 includes a bracket 498 mounted on the sewing machine 64 and an air cylinder 500 mounted on the bracket 498. A piston rod 502 extending from the air cylinder 500 is connected to a camming arm 504 which has a camming portion 506, as shown in FIG. 25, extending behind a tension release lever 508 which operates tension release plungers 510 and 512 of the thread tension mechanism 494 such that when the piston rod 502 is extended, the tension mechanism is released, and when the piston rod 502 is retracted, the tension mechanism 494 is rendered operative. Referring back to FIG. 1, a thread slack member 515 is mounted on the camming arm 504 and has a looped end 516 extending around the threads 414 and 416 between the guides 495 and 496 for drawing additional slack in the threads 414 and 416.

Figure 26:
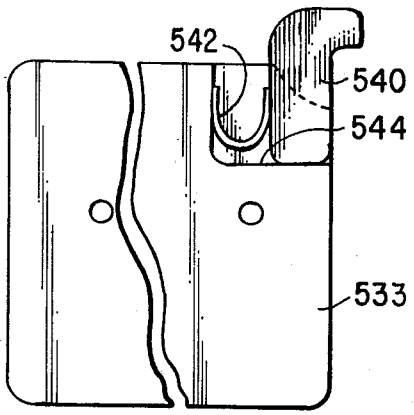
FIG. 26 is a bottom view of a folding plate with a spring biased seam closing member broken away from the apparatus of FIG. 1.
Figure 27:
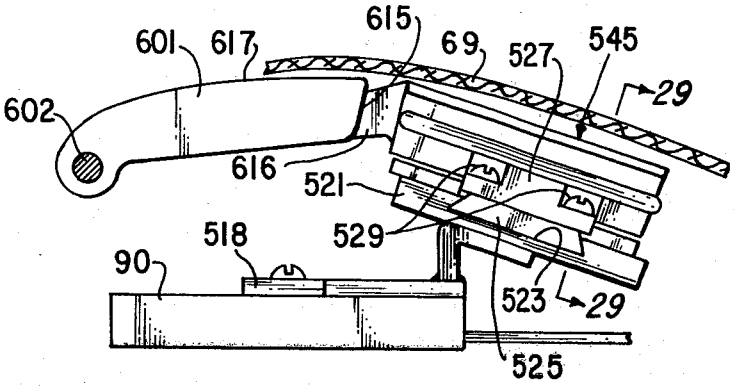
FIG. 27 is a side view from the right of an article terminal point sensing arm, article guiding mechanism, fastener chain and sensing and guiding mechanism and lower left and right thread cutting mechanism broken away from the apparatus of FIG. 1.
Figure 28:
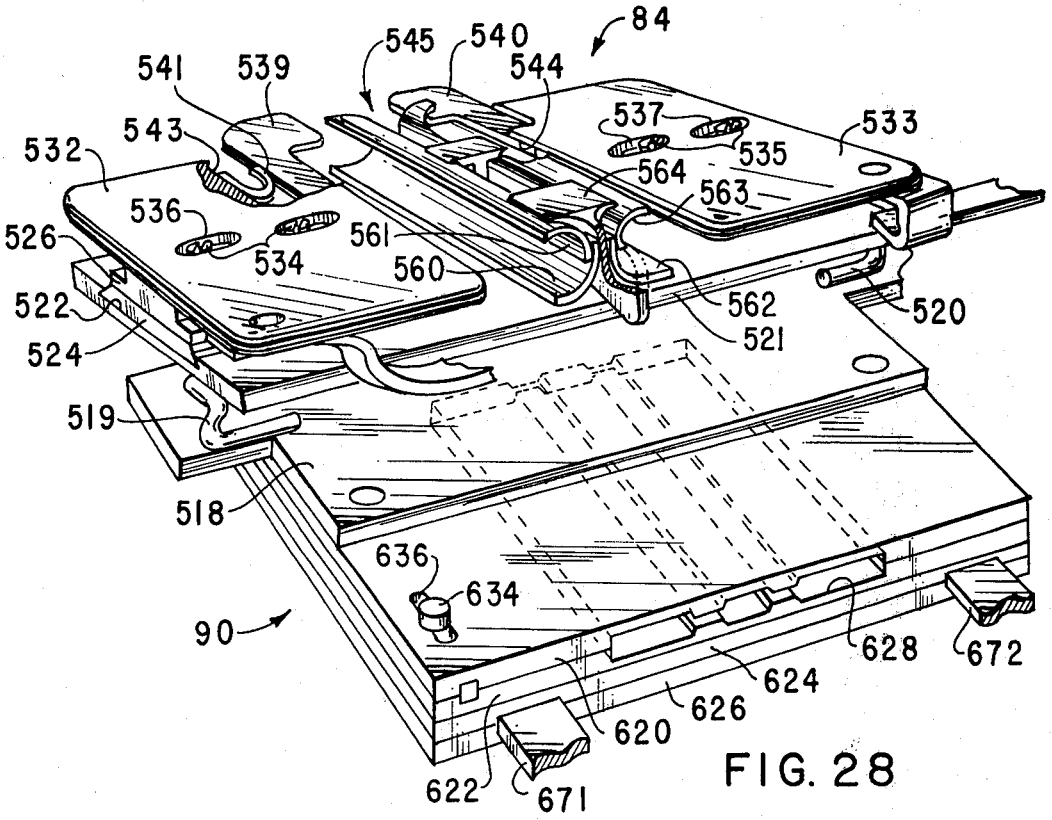
FIG. 28 is a perspective view of the article guiding mechanism, the fastener chain end sensing and guiding mechanism and the lower left and right thread cutting mechanism shown in FIG. 27.
Figure 29:
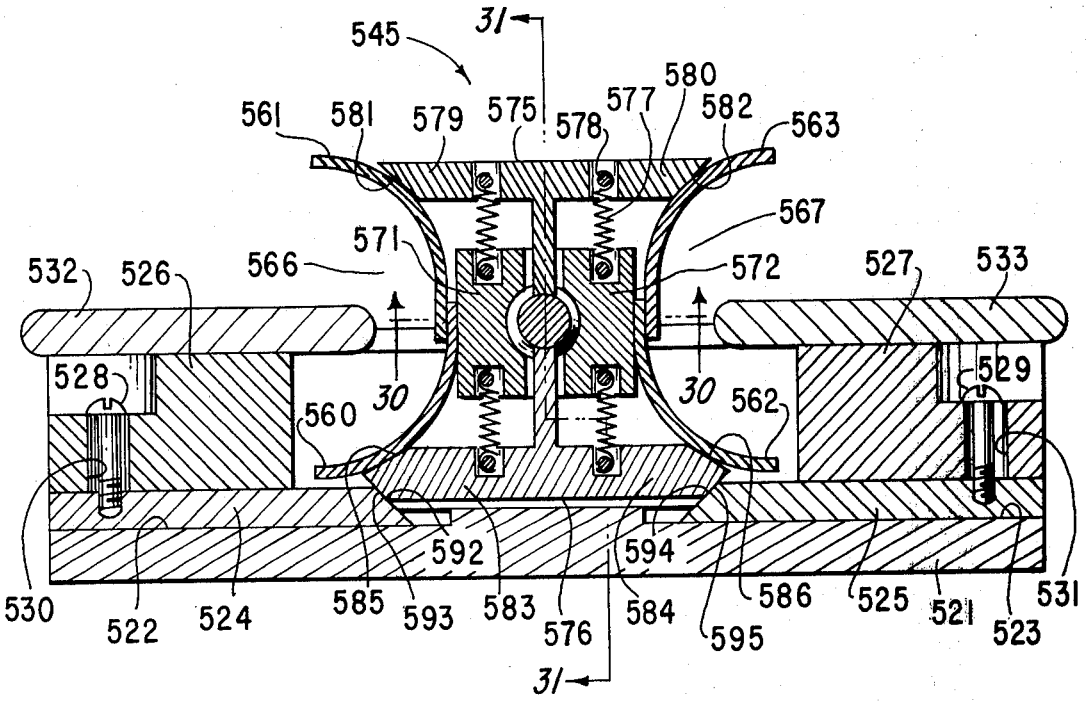
FIG. 29 is a cross section view from the front of the article guiding mechanism shown in FIGS. 27 and 28.

The article guiding mechanism 84, as shown in FIG. 28, includes a plate 518 suitably secured to the housing 90. Brackets 519 and 520 on the plate 518 support a slide guide plate 521 which, as shown in FIGS. 27, 28 and 29 have grooves 522 and 523 having dovetail cross sections slidably containing slide bars 524 and 525 with mating dovetail cross sections. Spacing plates 526 and 527 are adjustably secured to the respective slide bars 524 and 525 by screws 528 and 529 extending through slotted openings 530 and 531 in the respective spacing plates 526 and 527. Seam folding plates 523 and 533 are adjustably mounted on the respective spacing plates 526 and 527 by screws 534 and 535 which have head portions recessed within slots 536 and 537 in the folding plates 532 and 533. The folding plates 532 and 533 are mounted to slide in the same plate toward and away from each other and have seam closing members or tips 539 and 540 mounted on respective springs 541 and 542 (the latter shown in FIG. 26) secured within recesses 543 and 544 on the under side of the respective folder plates 532 and 533. The seam closing members 539 and 540 extend forward and inward toward each other to the rear of a double adjustable scroll indicated generally at 545.

Referring to FIG. 4, the folding plates 532 and 533 are connected by pivot pins 546 and 547 to respective links 548 and 549 (the latter shown as two joined portions) which are connected by pivot pins 551 and 552 to respective ends of a lever 553 which is pivotally mounted at its center by pin 554 on the base 85 of the sewing machine. An air cylinder 556, suitably mounted on the base 83, has a piston rod 557 which is attached by a pivot pin 558 to one end of the lever 553 for pivoting the lever 553 about the pivot pin 554 to move the folding plates 532 and 533 toward or away from each other.

As shown in FIG. 28, the double scroll 545 includes left scroll portions 560 and 561 and right scroll portions 562 and 563 suitably secured at their front ends to a block 564 which is suitably mounted on the slide guide plate 521. As illustrated in FIG. 29, the scroll portion 560 and 561 are curved to form a concave surface which forms a left seam allowance receiving channel 566, and the scroll portion 562 and 563 are curved to form a concave surface which forms a right seam allowance receiving channel 567. The scroll portions 560, 561, 562 and 563 are made from a suitable flexible spring like material and extend in a cantilever manner toward the rear.

Figure 31:
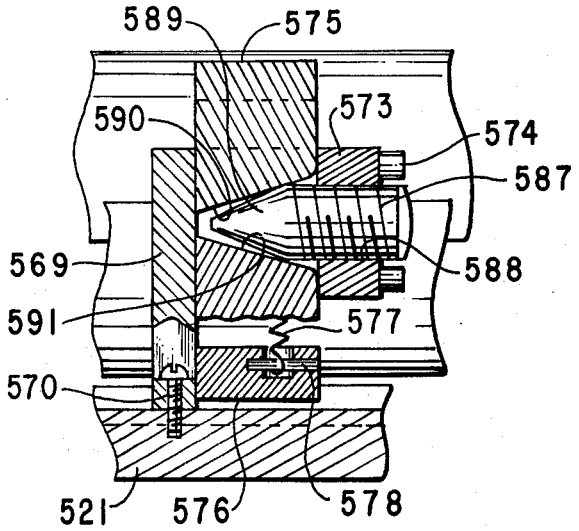
FIG. 31 is a detailed cross section view from the right of the scroll channel adjusting mechanism of FIG. 30.
Figure 30:
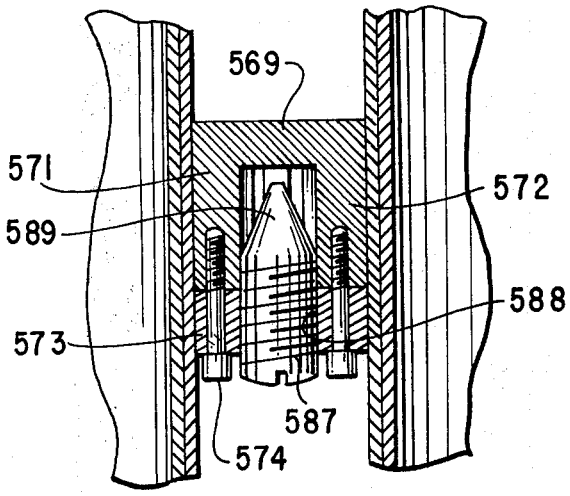
FIG. 30 is a detail cross section view from the bottom of a scroll channel adjusting mechanism broken away from article guiding mechanism shown in FIGS. 28 and 29.

A mechanism for adjusting the size or capacity of the channels 566 and 567 at the rear ends of the scroll portions 560, 561, 562, and 563 is illustrated in FIGS. 29, 30 and 31. A block 569 mounted by screws 570 on the slide guide plate 521 has bifurcations 571 and 572 extending between the left scroll portions 560 and 561 and the right scroll portions 562 and 563 with a plate 573 secured by screws 574 to the ends of the bifurcations 571 and 572. An upper clamping member 575 and a lower clamping member 576 are slidably mounted within a vertical guideway formed by the block 569, the bifurcations 571 and 572 and the plate 573. The claming members 575 and 576 are biased toward each other by tension springs 577 suitably secured by pins 578 in the clamping members 575 and 576 and the bifurations 571 and 572. The upper clamping member 575 has horizontally extending wing portions 579 and 580 with respective inclined edges 581 and 582 engaging the upper scroll portions 561 and 563. Similarly, the lower clamping member 576 has horizontally extending wing portions 583 and 584 wit upward facing respective inclined edges 585 and 586 engaging the lower scroll portions 560 and 562. An adjusting screw 587 in a threaded opening 588 in the plate 573 has a tapered end 589 engaging inner camming surfaces 590 and 591 of the respective upper and lower clamping members 575 and 576. The springs 577 are selected to provide sufficient tension force to bend the free rear ends of the scroll portions 560, 561, 562 and 563 to make the channels 566 and 567 smaller at their rear ends.

Referring to FIG. 29, the inward end of the slide bar 524 has an inclined edge 592 for engaging a mating downward facing inclined edge 593 on the wing portion 583 of the lower clamping member 576 such that the folding plate 532, when closed, extends into the channel a distance determined by the adjustment of the clamping members 575 and 576. Similarly the inward end of the slide bar 525 has an inclined edge 594 for engaging a mating downward facing inclined edge 595 on the wing portion 584 of the lower clamping member 576.

As illustrated in FIG. 4 a left frame 596 and a right frame 597 are suitably secured to the top of the table 65 and the base 85 for supporting the cover 81 (FIG. 1). The frame 596 has a threaded opening 598 while the frame 597 has a threaded opening 599 for receiving respective thumb screws 600 (only one shown in FIG. 1) to secure the cover 81 to the frames 596 and 597.

The article terminal point sensing mechanism 88 includes a sensing arm 601 mounted on a shaft 602 rotatably supported within a tubular bearing member 603 which is secured to a plate 604 mounted on the frame 597. The shaft 602 has cam 605 mounted thereon which is engaged by cam follower rod 606 slidably supported on a bearing guide member 607 and which operates an electrical switch 608. A coupling 609 joins the end of the shaft 602 to a flexible shaft 610 connected to an arm 611 rotatably mounted in a housing 612 containing an air valve 613. A manual lever 614 is secured to the flexible shaft 610 and the air vlave 613 is disposed relative to the arm 611 so as to be operated when the manual lever 614 is rotated fully toward the front.

As illustrated in FIG. 27 an end 615 of the sensing arm 601 is formed at a diagonal such that it mates with a projection 616 extending toward the front from the block 564 (FIG. 28) when the arm 601 is rotated to its rearmost position. The upper edge or surface 617 of the arm 601 extends above the front of the block 564 and scroll 545 such that the article 69 will be lifted above the block 564 and scroll 545.

Figure 33:
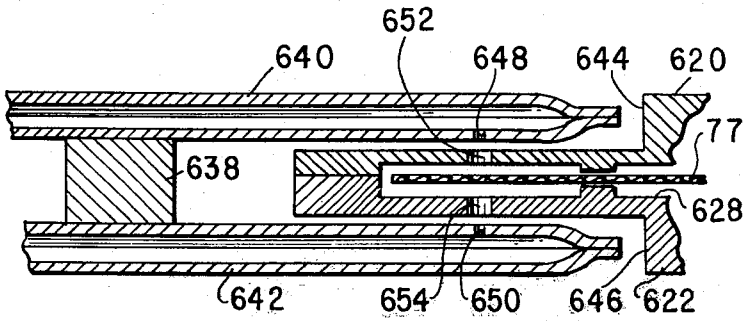
FIG. 33 is a detail cross section view of the fastener chain end sensing and guiding mechanism along line 33—33 of FIG. 32.
Figure 32:
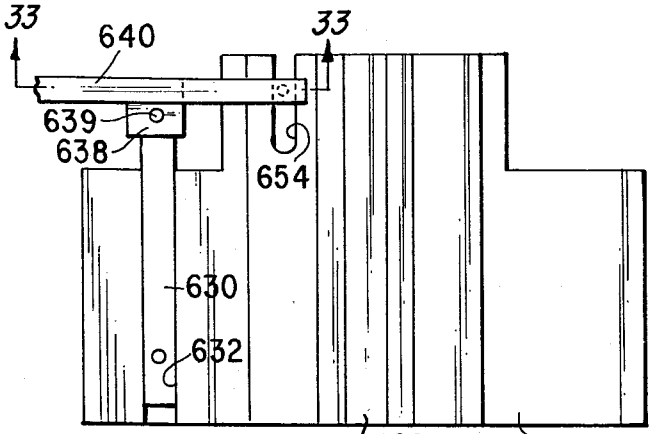
FIG. 32 is a top view of the fastener chain end sensing and guiding mechanism shown in FIG. 28.

Referring back to FIG. 28, the housing 90 includes an upper fastener chain guiding and sensing plate 620, a lower fastener guiding ans sensing plate 622, an upper lower thread cutting plate 624 and lower thread cutting plate 626 which are all suitably mounted together to the base 85 (FIG. 4) of the sewing machine. The fastener chain guiding and sensing plates 620 and 622 have their mating surfaces machined to form a fastener chain guiding passageway 628 extending therethrough from the front to the rear in front of the presser foot 87 (FIG. 1). As shown in FIG. 32, a bar 630 is slidably mounted within a guideway 632 machined in the mating surfaces of plates 620 and 622 and has a thumb screw 634 (FIG. 28) which extends through a slot 636 in the upper plate 620 for securing the slide bar 630 in a selected position. The rear end of the slide bar 630 has tube mounting block 638 secured thereto by a pin 639 and, as shown in FIG. 33, to which upper and lower flat tubular section 640 and 642 are secured. Closed ends of the tubular section 640 and 642 extend into recesses 644 and 646 formed in the respective plates 620 and 622 above and below a portion of the guide way 628. A hole 648 in the bottom of the upper tubular section 640 is aligned with an upward facing hole 650 in the lower tubular section 642. The holes 648 and 650 are disposed in alignment with a slot 652 in the upper plate 620 and a slot 654 in the lower plate 622 such that air passing from the tubular section 640 through holes 648 is impeded from passing into the hole 650 in the tubular section 642 by the presence of the fastener chain type 77 within the passageway 628. The slots 652 and 654 have a longitudinal length in the plate 620 and 622 selected to give the desired range of adjustments for stopping the sewing at a severed end of the fastener chain.

Figure 34:
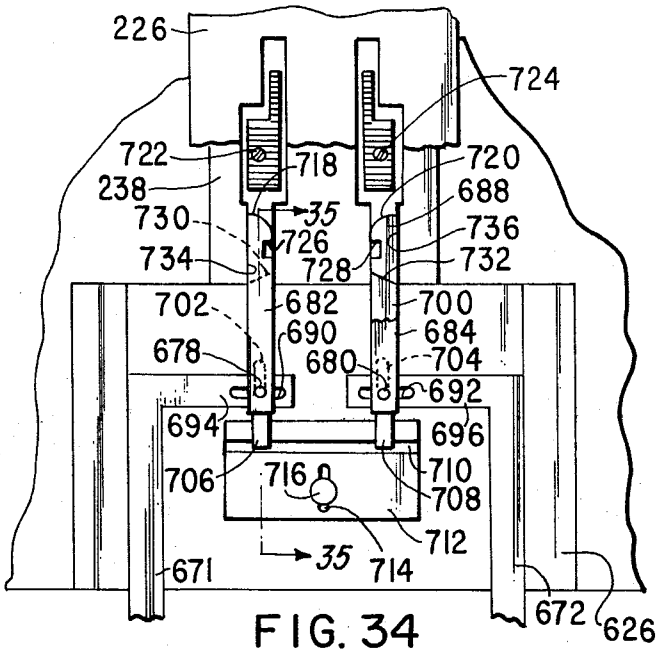
FIG. 34 is a top view of the lower left and right thread cutting mechanisms shown in FIG. 28.
Figure 35:
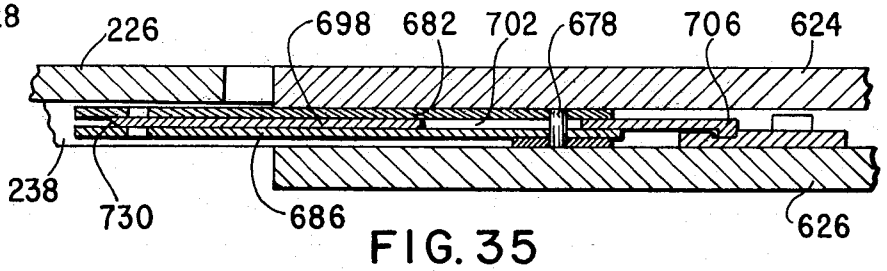
FIG. 35 is a detailed cross section view of the lower left thread cutting mechanism taken along line 35—35 of FIG. 34.

As illustrated in FIG. 4, the lower thread cutting mechanism includes a pair of brackets 658 and 660 which are mounted on the sewing machine base 85 and have respective air cylinders 662 and 664 secured thereto. Piston rods 666 and 668 extending from the air cylinders 662 and 664 are connected by pins 669 and 670 to slide bars 671 and 672 extending into guideways 674 and 676 formed in the mating surfaces of the plates 624 and 626 (FIG. 28). Referring to FIGS. 34 and 35, pins 678 and 680 secured to respective upper snagging blades 682 and 684 and to respective lower snagging blades 686 and 688 extend into slotted openings 690 and 692 within inwardly extending arms 694 and 696 of the slide bars 671 and 672. A left cutting blade 698 is disposed between the snagging blades 682 and 686. A right cutting blade 700 is disposed between the snagging blades 686 and 688. Slotted openings 702 and 704 are formed in the respective cutting blades 698 and 700 through which the pins 678 and 680 extend. The front ends 706 and 708 of the respective cutting blades 698 and 700 are bent to extend within a groove 710 formed within a adjustable block 712 which has a slot 714 through which a screw 716 extends to adjustably secure the block 712 to the lower plate 626. Curved ends 713 and 720 of the respective left pair of snagging blades 682 and 686, and right pair of snagging blades 684 and 688 are designed to cam respective threads 722 and 724 extending from bobbins to an article such that they are snagged by hook portions 726 and 728 of the respective left pair of snagging blades 682 and 688 and right pair of snagging blades 684 and 688. Severing or knife edges 730 and 732 on the respective cutting blades 698 and 700 are formed at a diagonal such that the threads are both severed and torn when the snagging blades 682, 684, 686 and 688 are retracted in a manner similar to the upper thread cutting mechanism. The ends 718 and 720 of the snagging blades 682, 684, 686 and 688 as well as the knife edges 730 and 732 of the cutting blades 698 and 700 extend into guide grooves or slots 734 and 736 which are formed in the throat plate 238 below the transverse feed plate 226.

Figure 37:
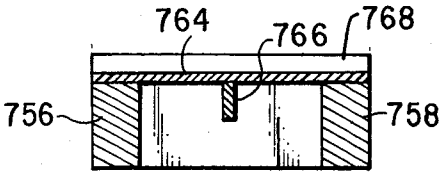
FIG. 37 is a detail cross section view of fastener chain cutting blades taken along line 37—37 of FIG. 36.
Figure 36:
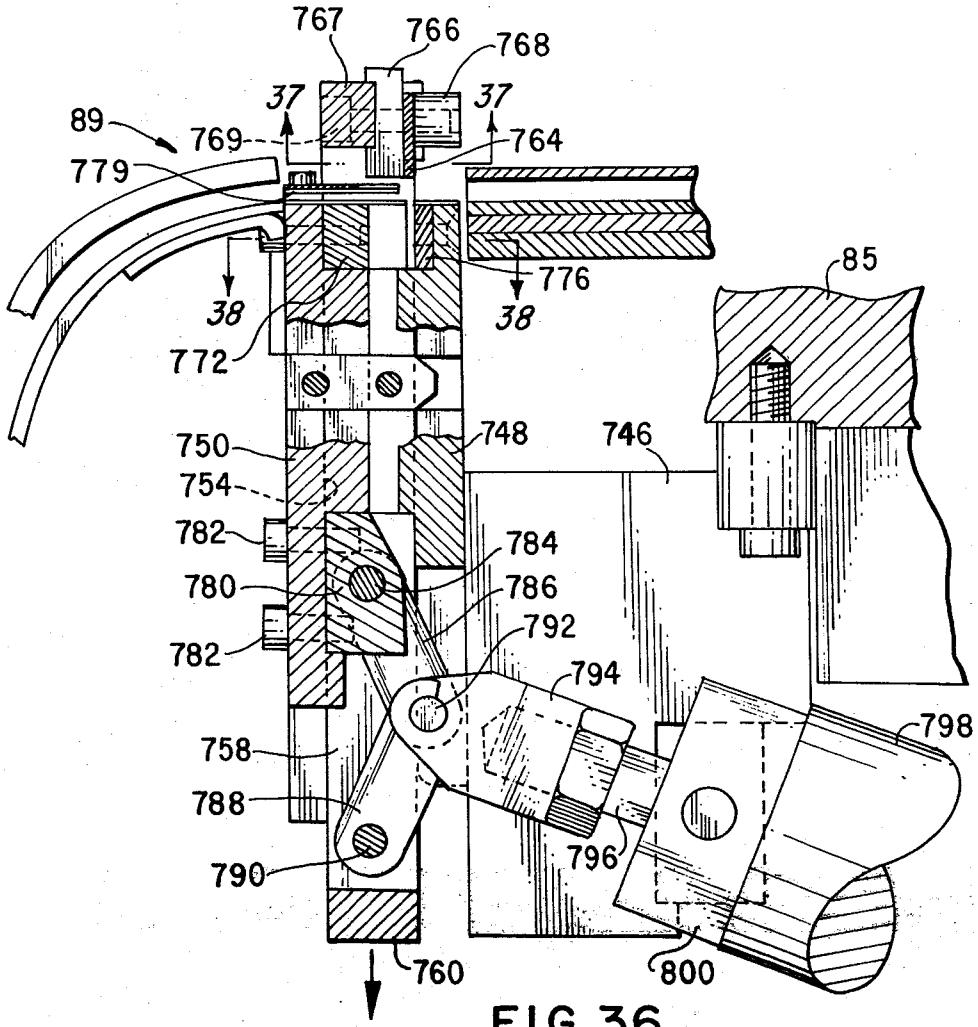
FIG. 36 is a cross section view taken from the right of a fastener chain cutting mechanism broken away from apparatus of FIG. 1.

The fastener chain cutting mechanism 89 is illustrated in FIGS. 36, 37 ad 38 and has side brackets 746 (only one shown) suitably mounted on the underneath portion of the sewing machine base 85, with a rear plate 748 suitable secured to the bracket 746. A front plate 750 suitably made to form guideways 752 and 754 for vertically extending arm portions 756 and 758 of a rectangular yoke-like movable member 760 is suitably secured to the rear plate 748 by screws 762. A transverse cutting blade 764 and a fastener element cutting blade 766 are secured to an upper beam portion 767 of the yoke member 760 by a securing plate 768 fastened by suitably screws 769. A stationary cutting die includes a die block 772 secured by screws 774 to the front plate 750 and a rear die block 776 secured to the rear plate 748 by screws 778 to form an opening which mates with the cutting blades 764 and 766. A fastener chain guide 779 suitably mounted on the front plate 750 is suitably shaped to form a guiding passageway for the fastener chain between the cutting blades 764 and 766 and the die blocks 772 and 776. A pivot block 780 secured to the front cover 750 by screws 782 has a pin 784 which pivotally connects to one end of links 786. Links 788 are pivotally mounted at one end on a pin 790 which is secured to the lower portion of the yoke member 760. The links 788 and 786 are pivotally mounted at their other ends to a pin 792 in a clevis 794 to form a toggle joint. The clevis 794 is mounted on a piston rod 796 extending from an air cylinder 798 which is pivotally mounted by pivot block 800 within the side brackets 746.

Figure 39:
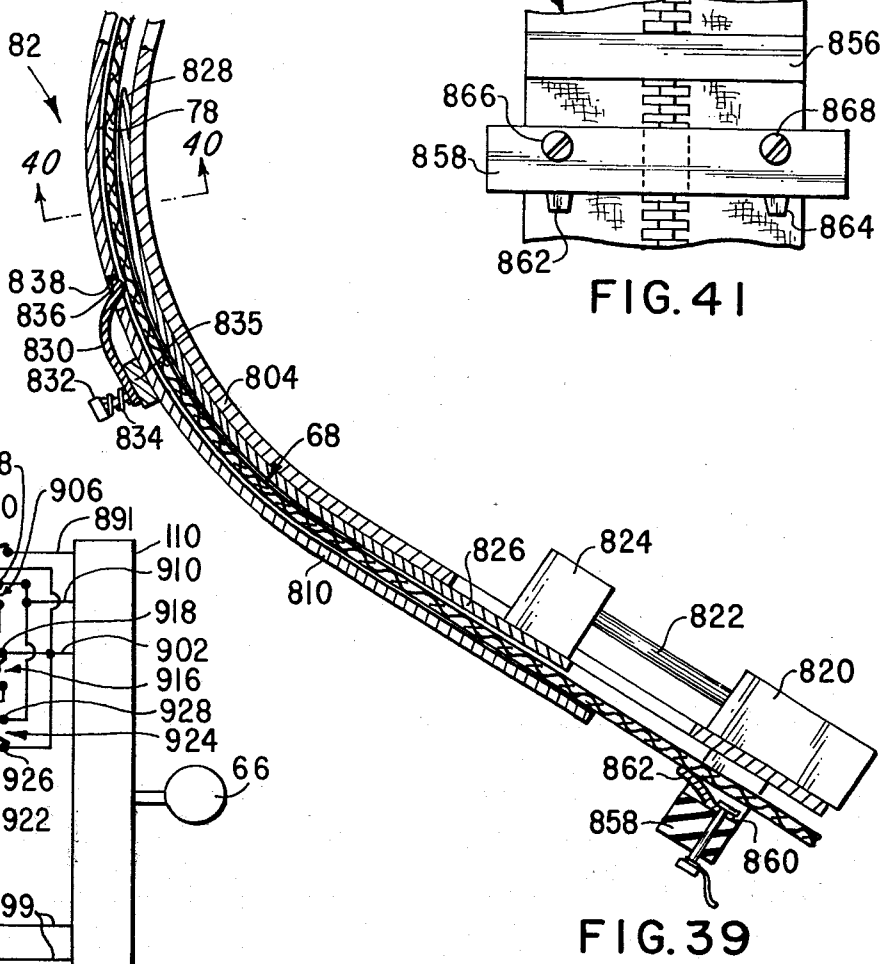
FIG. 39 is a side cross section view from the right of a tape feeding and guiding mechanism and fastener chain fault sensing mechanism broken away from the apparatus of FIG. 1.
Figure 40:
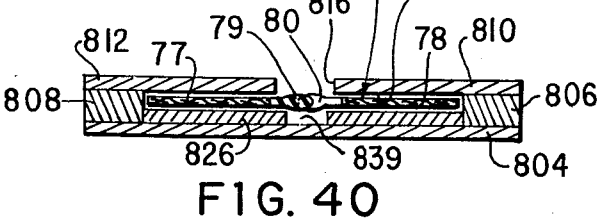
FIG. 40 is a detail cross section view of the tape feeding and guiding mechanism taken along line 40—40 in FIG. 39.

The fastener chain feeding and guiding mechanism 82, as illustrated in FIGS. 39 and 40, includes a back plate 804 to which are secured side plates 806 and 808 and front plates 810 and 812 so as to form a guideway 814 for the fastener chain 68. The front plates 810 and 812 are spaced to leave a slot 816 therebetween which forms a guidway for the fastening elements 79 and 80 of the fastener chain 68. An air cylinder 820 mounted on the lower end of the back plate 804 has a piston rod 822 which is fastened to a bracket 824 secured to one end of a spring advancing member 826 between the back plate 804 and the fastener chain 68. The other end 828 of the advancing member 826 has suitably pointed portions so as to engage the tapes 77 and 78 of the fastener chain 68 when the piston rod 822 is advanced. A spring pawl member 830 mounted by screws 832 and springs 834 on a block 835 secured on the front plates 810 and 812 has pointed prongs 836 which extend into respective openings 838 of the front plates 810 and 812 (see FIG. 40) to engage and hold the tapes 77 and 78 of the fastener chain when the advancing member 826 is returned. The advancing member 816 has central longitudinally spaced apertures 839 to reduce frictional engagement with the fastening elements 79 and 80.

As illustrated in FIG. 1 the fastener chain 68 is feed from a reel 846 which is driven by a motor 848 controlled by a conventional tension control 850. A crank arm 852 extends from the tension control 850 for sensing the slack or tension in the fastener chain 68 to selectively advance the reel 846.

Figure 41:
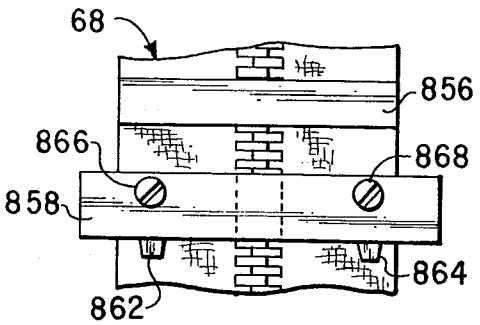
FIG. 41 is a bottom view of the fastener chain fault sensing mechanism shown in FIG. 39.

The fastener chain 68, as shown in FIG. 41, has a conductive foil 856 attached thereto wherever there is a defect, such as a splice, in the fastener chain. A sensor for sensing the conductive foil 856 includes an insulative block 858 mounted on the back plate 804, as illustrated in FIG. 39, and has a suitable guideway 860 for passing the fastener chain 68. A pair of spring contacts 862 and 864 are mounted by terminal pins 866 and 868 in the block 858 such that they will simultaneously engage and make electrical contact with the foil 856 when it passes through the guideway 860.

Figure 42:
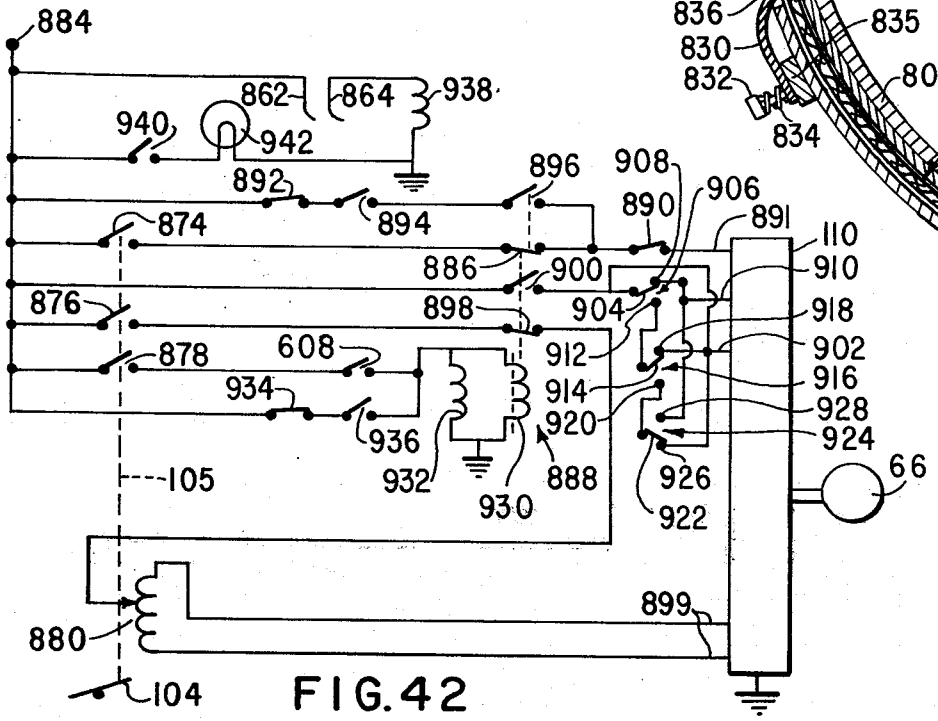
FIG. 42 is a diagram of an electrical control circuit of the apparatus of FIG. 1.

The electrical control circuit for the sewing apparatus is illustrated in FIG. 42 and includes normally open switches 874, 876, and 878 and a potentiometer 880 which are operated by the connecting rod 105 from the treadle 104. The switch 874 is connected in series with a power terminal 884 and normally closed contacts 886 of an automatic cycle relay, indicated generally at 888, and a normally closed air switch 890 to a power control terminal 891 of the motor control circuit 110 to allow operation of the motor 66. An alternate enabling path for the power control terminal 891 is through a normally closed air switch 892, a normally open air switch 894 and normally open contacts 896 of the automatic cycle relay 888 to the normally closed air switch 890. The slider of the potentiometer 880 is connected through normally closed contacts 898 of the automatic cycle relay 888 and the switch 876 to the power terminal 884 while the other terminals of the potentiometer 880 are connected to motor speed control terminals 899 of the motor control circuit 110. Normally open contacts 900 of the relay 888 are connected between the power terminal 884 and a low speed input terminal 902 of the motor control circuit 110. The terminal 902 is connected to a contact arm 904 of an air switch indicated generally at 906, which has a normally closed contact 908 connected to a high speed input terminal 910 of the motor control circuit 110. A normally open contact 912 of the air switch 906 is connected to a contact arm 914 of an air switch indicated generally at 916 which has a normally closed contact 918 connected to the low speed terminal 902. A normally open contact 920 of the air switch 916 is connected to a contact arm 922 of an air switch indicated generally at 924 which has a normally closed contact 926 connected to the low speed terminal 902. A normally open contact 928 of the air switch 924 is connected to the high speed terminal 910.

The motor control circuit 110 is any suitable circuit which can be used to operate a motor at variable speeds under the control of variable voltages from a potentiometer, a variable speed terminal, a low speed terminal and a high speed terminal. Many suitable circuits are believed to be either available or can be readily designed from the prior art.

The automatic cycle relay 888 has a coil 930 which is connected in series with the normally open terminal point sensing switch 608 and the switch 878. An air valve solenoid 932 is connected in parallel to the coil 930. A normally closed air switch 934 is connected in series with a normally open air switch 936 across the switches 878 and 608 for providing an alternate energizing path for the coil 930 and the solenoid 932. The power terminal 884 is connected in series with the spring contacts 862 and 864 and an air valve solenoid 938 while a normally open air switch 940 is connected between the power terminal 884 and a lamp 942.

Figure 43:
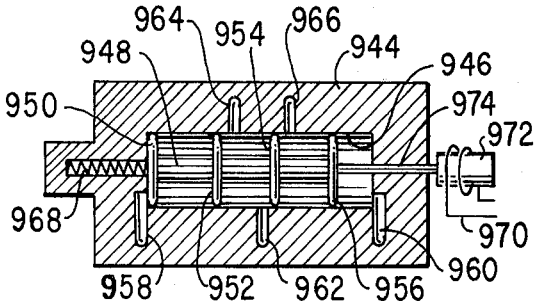
FIG. 43 is a cross section view of a five port pneumatic valve illustrating principles of various five port valves employed in the apparatus of FIG. 1 with a valve member in a first position.
Figure 44:
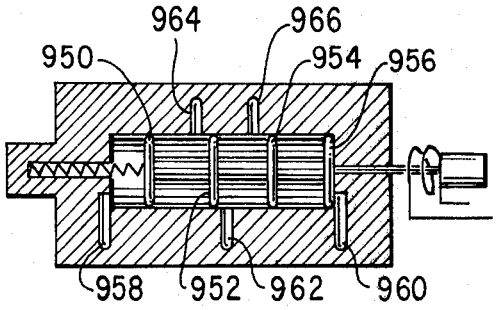
FIG. 44 is a view similar to FIG. 43 but illustrating a second position of the valve member.

In FIGS. 43 and 44 there is shown in five port pneumatic valve which is illustrative of various five port valves used in the pneumatic control circuit. The five port valve has a block 944 which has a cylindrical cavity 946 containing a slidable valve member 948 which has spaced O-ring seals 950, 952, 954 and 956. A first port 958 communicates into the left end of the cavity 946 for applying air pressure upon the left end of the valve member 948 to the urge the valve member 948 to the right. A second port 960 communicates with the right end of the cavity 946 for applying air pressure to the right end of the valve member 948 to urge the valve member 948 to the left. A third port 962, a fourth port 964 and a fifth port 966 communicate through spaced openings in the cavity 946; and the seals 950, 952, 954, and 956 are spaced; such that, when the valve member 948 is in the left position as shown in FIG. 43, the third port 962 communicates with the fourth port 964 between the seals 952 and 954 while the fifth port 966 is isolated by the seals 954 and 956, and when the valve member is in the right position as shown in FIG. 44, the third port 962 communicates with the fifth port 966 between the seals 952 and 954 while the fourth port 964 is isolated by the seals 950 and 952. In addition, some five port valves have a spring return such as a compression spring 968 between one end of the valve member 848 and an end of a recess in one end of the cylinder cavity 946. Also, some five port valves are provided with a solenoid including a coil 970 and an armature 972 connected with a valve moving member 974 for engaging an end of the valve member 948 to move the valve member 948. The return springs and solenoids are designed to exert less force on the valve member 948 than the force produced by the air pressure applied to either of the first and second ports 958 and 960.

Figure 45:
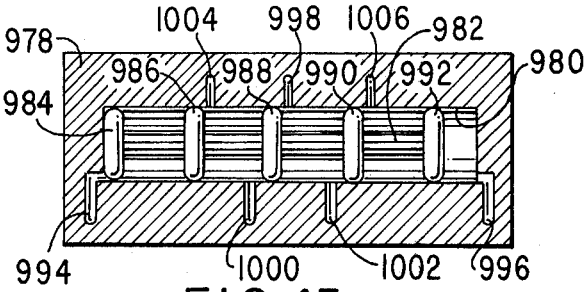
FIG. 45 is a cross section view of a seven port pneumatic valve illustrating principles of various seven port valves employed in the apparatus of FIG. 1 with a valve member in a first position.
Figure 46:
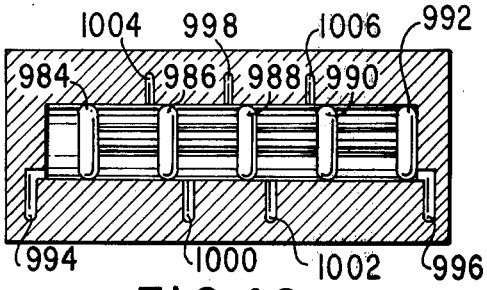
FIG. 46 is a view similar to FIG. 45 but illustrating a second position of the valve member.

In FIGS. 45 and 46 there is shown a seven port valve which is illustrative of seven port valves used in the pneumatic control circuit. The seven port valve has a block 978 with a cylindrical cavity 980 containing a slidable valve member 982 which has O-ring seals 984, 986, 988, 990 and 992 spaced thereon. A first port 994 communicates with a left end of the cavity 980 to apply air pressure against the left end of the valve member 982 to urge the valve member 982 to the right. A second port 996 communicates with the right end of the cavity 980 to apply air pressure against valve member 982 to urge the valve member 982 to the left. The seals 984, 986, 988, 990 and 992 are positioned on the valve member 982; and a third port 998, a fourth port 1000, a fifth port 1002, a sixth port 1104 and a seventh port 1006 communicate with spaced openings in the cavity 980; such that, when the valve member 982 is in the left position as illustrated in FIG. 45 the third port 998 communicates with the fifth port 1002 between seals 988 and 990, the fourth port 1000 communicates with the sixth port 1004 between seals 986 and 988, and the seventh port 1006 is isolated by seals 990 and 992; and when the bobbin 982 is in the position to the right as illustrated in FIG. 46, the third port 998 communicates with the fourth port 1000 between the seals 986 and 988, the fifth port 1002 communicates with the seventh port 1006 between the seals 988 and 990, and the sixth port 1004 is isolated by the seals 984 and 986. Some seven port valves in the pneumatic control circuit are provided with a spring return in the same manner as the five port valve illustrated in FIGS. 43 and 44.

Figure 47:
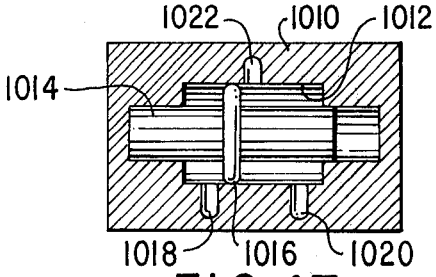
FIG. 47 is a cross section view of a shuttle valve illustrating principles of various shuttle valves employed in the apparatus of FIG. 1 with a valve member in a first position.
Figure 48:
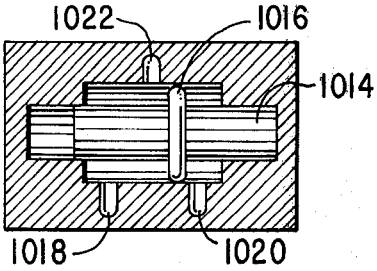
FIG. 48 is a view similar to FIG. 47 but illustrating a second position of the valve member.

In FIGS. 47 and 48 there is shown a shuttle valve which is illustrative of various shuttle valves of the pneumatic control circuit. The shuttle valve has a block 1010 with a cylindrical cavity 1012 containing a valve member 1014 which has an O-ring seal 1016 thereon. A first port 1018 and a second port 1020 communicate with the cylinder cavity on opposite sides of the seal 1016 while a third port 1022 communicates with an opening centrally spaced within the cavity 1012; such that, when air pressure is applied to the first port 1018, the valve member 1016 is urged to the right as illustrated in FIG. 48 to allow the first port 1018 to communicate with the third port 1022 whereby the second port 1020 is isolated, and when an air pressure is applied to the second port 1020, the valve member 1016 is urged to the left as illustrated in FIG. 47 to allow communication from the second port 1020 to the third port 1022 with the first port 1018 isolated.

Figure 49:
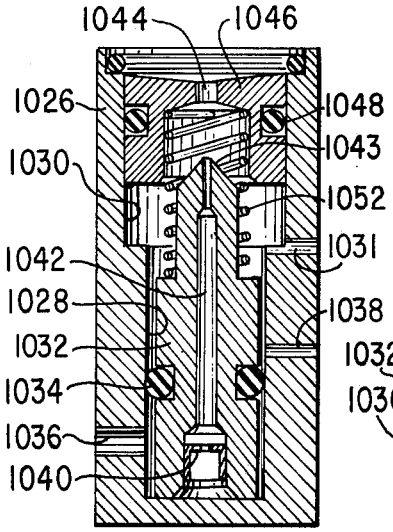
FIG. 49 is a cross section view of an impulse valve illustrating principles various impulse valves employed in the apparatus of FIG. 1 with small and large pistons in first positions.
Figure 50:
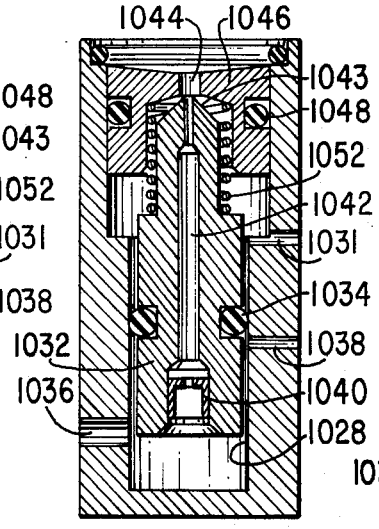
FIG. 50 is a view similar to FIG. 49 but illustrating the small piston in a second position.
Figure 51:
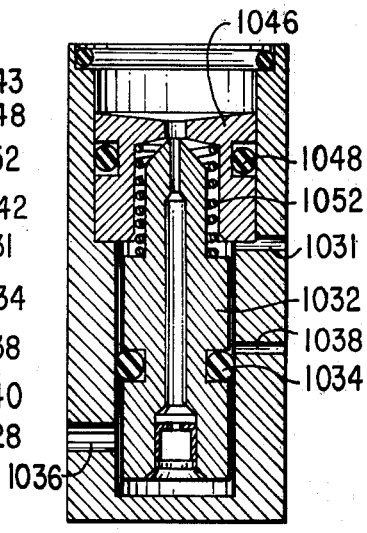
FIG. 51 is a view similar to FIGS. 49 and 50 but illustrating the large piston in a second position.

In FIGS. 49, 50, and 51 there is shown an impulse valve which is illustrative of various impulse valves which are included in the pneumatic control curcuit. The impulse valve has a block 1026 which contains a cylinder cavity including a lower small cavity portion 1028 and a upper larger cavity portion 1030 with an exhaust 1031 opening at the junction of the cavity portions 1028 and 1030. A small tubular piston 1032 is contained within the smaller cavity portion 1028 and has a O-ring seal 1034 which is disposed above an input port 1036 communicating with the lower portion of the smaller cavity portion 1028 such that air pressure applied to the input port 1036 urges the small piston 1032 upward. An output port 1038 communicates with the smaller cavity portion 1028 such that, when the small piston 1032 is in the raised position as shown in FIG. 50, the input port 1036 communicates with the output port 1038 below the seal 1034. Additionally the input port 1036 communicates through a restriction 1040 to a central passsageway 1042 extending through the small piston 1032. The upper end 1043 of the small piston 1032 is bevelled such that, when the small piston 1032 is in the raised position, the end 1043 seats with a central passageway 1044 extending through a large tubular piston 1046 which has an O-ring seal 1048 within the large cavity portion 1030. The large piston 1046 has a diameter which is sufficiently greater than the small piston 1032 that restricted flow of air through the restriction 1040 and passageways 1042 and 1044 to the upper portion of the larger cavity portion 1030, after a duration, forces the pistons 1046 and 1032 downward as illustrated in FIG. 51 to position the seal 1034 between the input port 1036 and the output port 1038 and to connect the output port 1038 to the exhaust 1031. A compression spring 1052 is disposed between the small piston 1032 and the large piston 1046 to return the large piston 1046 to its raised position as illustrated in FIG. 49 after air pressure is removed from the input port 1036.

Figure 52:
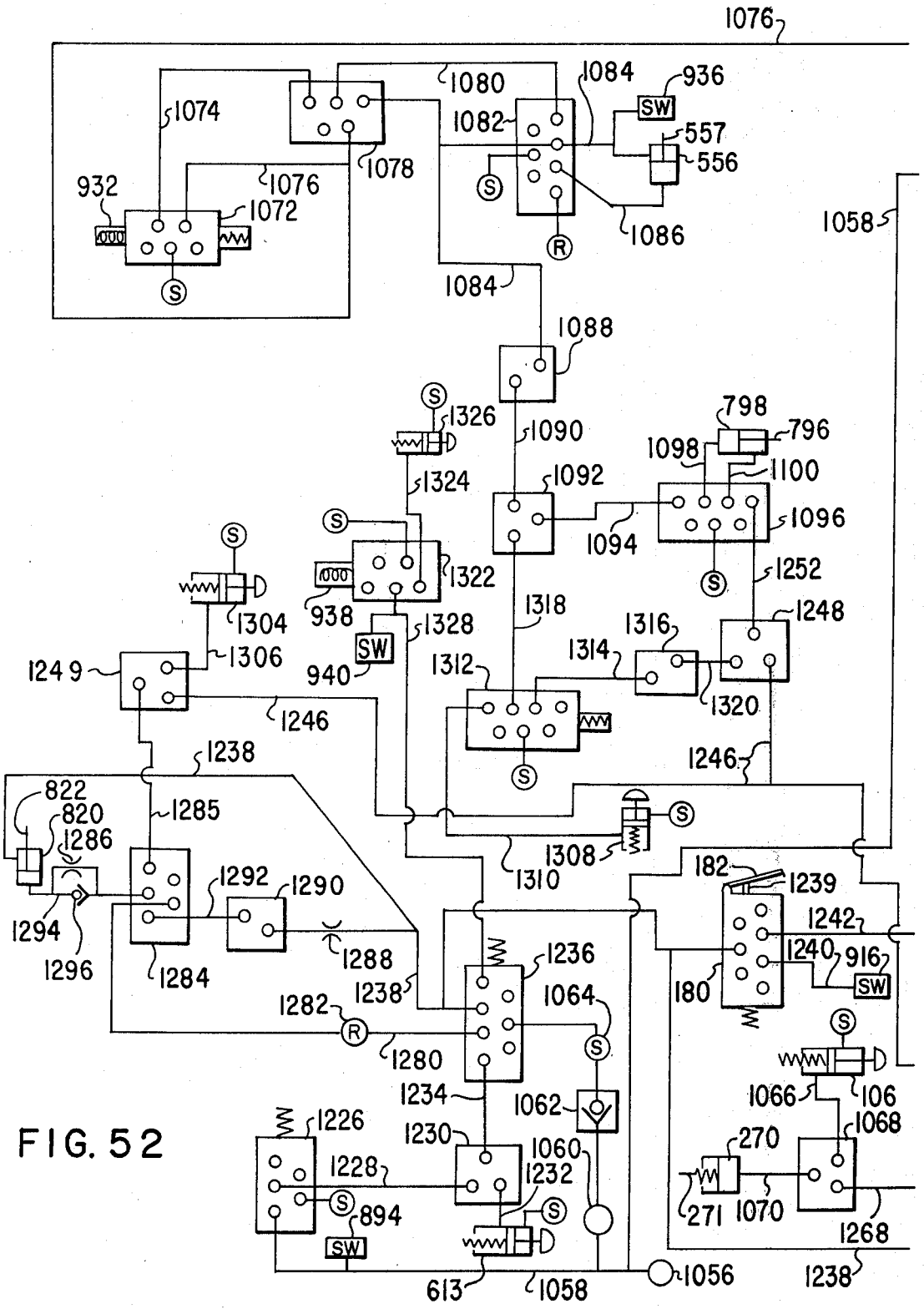
FIG. 52 is a diagram of a first portion of a pneumatic control circuit of the apparatus of FIG. 1.
Figure 53:
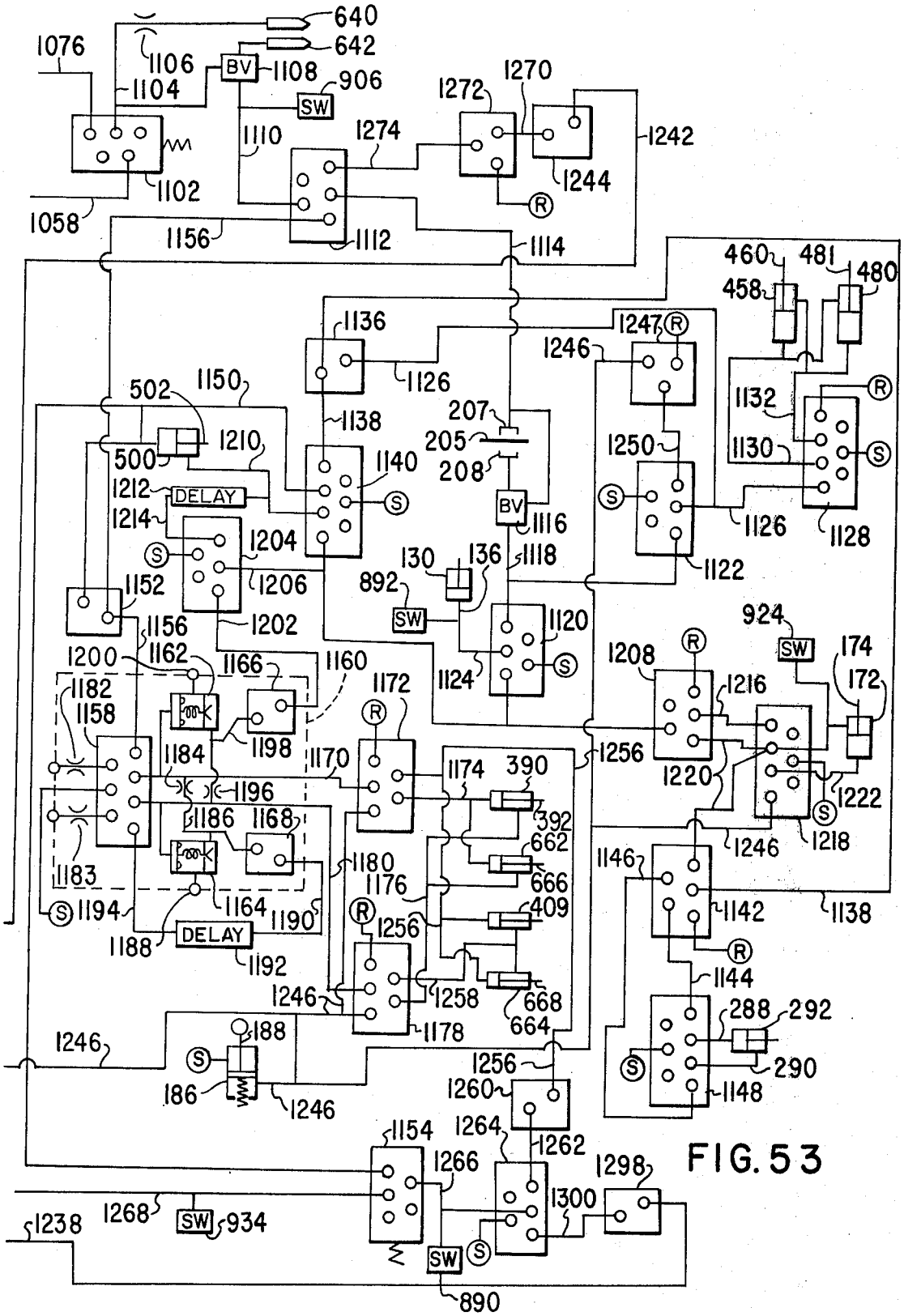
FIG. 53 is a diagram of a second portion of the pneumatic control circuit of the apparatus of FIG. 1.

The pneumatic control circuit is illustrated in two portions in FIGS. 52 and 53 which can be placed side-by-side with FIG. 52 on the left and FIG. 53 on the right to show the whole pneumatic control circuit. Various ports of valves in the pneumatic circuit are not shown connected to any conduit; such non-connected ports are left open and sometimes used as exhaust ports. Branches of the same conduit are identified by the same reference numerals.

A suitable air source 1056 is connected to a conduct 1058 which in turn is connected to the air switch 894 and a oil lubricating device 1060 in series with a one way valve, such as ball valve 1062, to a supply manifold 1064. The supply manifold 1064 is connected to various ports and valves in the pneumatic control circuit and is indentified through out the drawings by an *s* and is referred to as "supply". The knee valve 106, normally biased closed by a spring return with its output exhausted is connected between the supply and a conduit 1066 which is connected to the first port of a shuttle valve 1068. The third port of the shuttle valve 1068 is connected by a conduit 1070 to the presser foot lift air cylinder 270.

A five port valve 1072, with a spring return normally connecting the third port to the fourth port, includes the solenoid 932 for connecting the third port to the fifth port when the solenoid 932 is energized. The third port of the valve 1072 is connected to the supply while the fourth and fifth ports of the valve 1072 are connected to respective conduits 1074 and 1076. The end O-ring seal (see 950 in FIG. 43) isolating the fourth port from the first port when the solenoid 932 is operated is removed from the valve 1072 such as to allow the conduit 1074 to exhaust through the first port. A five port valve 1078 has its fifth port connected to the conduit 1076 and its first port connected to the conduit 1074. The third port of the valve 1078 is connected to a conduit 1080 which is connected to the first port of a seven port valve 1082. The third port of the valve 1082 is connected to the supply while the fourth port of the valve 1082 is connected by a conduit 1084 to the piston rod retract input of the folder air cylinder 556. The fifth port of the valve 1082 is connected to conduit 1086 communicating with the advance input of the air cylinder 556.

The conduit 1084 is also connected to the second port of the valve 1078, the air switch 936 and to the input port of an impluse valve 1088 which has its output port connected by a conduit 1090 to the first port of a shuttle valve 1092. The third port of the shuttle valve 1092 is connected to a conduit 1094 communicating with the first port of a seven port valve 1096. The third port of the valve 1096 is connected to the supply while the fourth and fifth ports of the valve 1096 are connected by the respective conduits 1098 and 1100 to the respective advance and return inputs of the fastener chain cutter air cylinder 798.

Conduit 1076 is also connected to a first port of a five port valve 1102 which has a spring return normally connecting the third port to the fourth port. The fifth port of the valve 1102 is connected to the conduit 1058 to provide a non-oil-containing air supply for the third port of the valve 1102 connected to a conduit 1104 which is connected by a restriction 1106 to the tubular section 640 of the fastener chain guiding and sensing mechanism. The tubular section 642 is connected to a sensing input of booster valve 1108 which has another input connected to the conduit 1104. The booster valve 1108 is any suitable valve which operates on a very low pressure differential applied to the sensing input to connect another input to an output; such valves are well known and commercially available. The output of the booster valve 1108 is connected by a conduit 1100 to the air switch 906 and to the fourth port of a five port valve 1112. The third port of the valve 1112 is connected by a conduit 1114 to the tube section 207 located on one side of the piston disc 205 and to an input of a booster valve 1116 which is similar to valve 1108. The tube 208 on the opposite side of the position disc 205 is connected to the sensing input of the booster valve 1116 which has its output connected to a conduit 1118 communicating with the first ports of five port valves 1120 and 1122. The fifth port of the valve 1120 is connected to the supply while its third port is connected by a conduit 1124 to the air switch 892 and to the conduit 136 and the brake cylinder 130. The fifth port of the valve 1122 is connected to the source and has its third port connected by a conduit 1126 to the first port of a seven port valve 1128 which has its third port connected to the supply and its fourth and fifth ports connected to respective conduits 1130 and 1132. The piston rod advance input of the zero rocking feed air cylinder 458 and the retract input of the feed dog dropping air cylinder 480 are connected to the conduit 1130 while the retract input of air cylinder 458 and the advance input of air cylinder 480 are connected to the conduit 1132.

Conduit 1126 is also connected to the input port of an impulse valve 1136 which has its output port connected by a conduit 1138 to the first port of a seven port valve 1140 and to the third port of a five port valve 1142. The fourth and fifth ports of the valve 1142 are connected by respective conduits 1144 and 1146 to respective first and second ports in a seven port valve 1148 which has its third port connected to the supply and its fourth and fifth ports connected to the respective conduits 288 and 290 operating the needle retracting air cylinder 292. The third port of the valve 1140 is connected to the supply and the fourth port of the valve 1140 is connected to a conduit 1150 which communicates with the advance input of the thread tension release air cylinder 500, with the input of an impulse valve 1152, and with the first port of a not valve 1154. The not valve 1154 is illustrated as a five port valve with a spring return normally biasing the valve 1154 to connect its fourth port to its third port. Conduit 1156 from the output port of impulse valve 1152 is connected to the first port of the valve 1112 and to the first port of a seven port valve portion 1158 of a logic valve 1160.

The logic valve 1160 is conveniently a unit which contains the seven port valve 1158 as well as diaphragm valves 1162 and 1164 along with impulses valves 1166 and 1168 connected by the conduits and restrictions illustrated within the dotted lines. The third port of the valve 1158 is connected to the supply and the fourth port of the valve 1158 is connected to a conduit 1170 which is connected to the third port of a five port valve 1172. The fifth port of the valve 1172 is connected by a conduit 1174 to the piston advancing input of both the upper left thread cutting air cylinder 390 and the lower left thread cutting air cylinder 662. The return or piston retracting inputs of the air cylinders 390 and 662 are connected by a conduit 1176 to the fifth port of a five port valve 1178 which has its third port connected by conduit 1180 to the fifth port of the valve 1158 and to the operating chamber of the diaphragm valve 1164 so as to open the valve 1164 so long as air pressure exists within conduit 1180. The sixth and seventh ports of the valve 1158 are connected through respective restrictions 1182 and 1183 to exhaust ports. A restriction 1184 connects the conduit 1170 to a conduit 1186 which is connected by a normally closed valve portion of the diaphragm valve 1164 to an exhaust 1188 such that pressure is not built up within the conduit 1186 until the relative pressure within the conduit 1180 drops sufficiently to allow the diaphragm valve 1164 to close. The input port of the impulse valve 1168 is connected to the conduit 1186 and has it output port connected in series with a conduit 1190, a delay chamber 1192 and a conduit 1194 to the second input of the valve 1158. The conduit 1170 is connected to the diaphragm operating chamber of the valve 1162, and a restriction 1196 joins the conduit 1180 to a conduit 1198 which is connected through a normally closed valve portion of the diaphragm valve 1162 to an exhaust 1200 such that relative air pressure within the conduit 1198 which is connected to the input port of the impulse valve 1166 is insufficient to operate the impulse valve 1166 while the piston rods 392 and 666 are retracting.

The output port of the impulse valve 1166 communicates with a conduit 1202 which is connected to a first port of a five port valve 1204. The fifth port of the valve 1204 is connected to the supply while the third port of the valve 1204 communicates with a conduit 1206 which is connected to the second port of the valve 1140, the second port of the valve 1120 and the fourth port of a five port valve 1208. The fifth port of the valve 1140 is connected to a conduit 1210 which is connected to a retract input of the thread tension air cylinder 500 and by a delay chamber 1212 to a conduit 1214 connected to the second port of the valve 1204. The third port of the valve 1208 is connected by a conduit 1216 to the first port of a seven port valve 1218 which is its third port connected to the supply and its fourth port connected to a conduit 1220. The retract input port of the cam clutch air cylinder 172, the first port of the valve 1208 and the second port of the valve 1142 communicate with the conduit 1220. The fifth port of the valve 1218 is connected by a conduit 1222 to the advance input of the air cylinder 172.

The conduit 1058 from the air source 1056 is connected to a first port of a five port valve 1226 which has a spring return normally connecting the third port of the valve 1226 to its fourth port which is connected to the source. The third port of the valve 1226 communicates with a conduit 1228 which is connected to a first port of a shuttle valve 1230. The second port of the shuttle valve 1230 is connected by conduit 1232 to the reset valve 613 which is spring biased closed and connected to the supply so as to apply air pressure to the shuttle valve 1230 when operated and to exhaust conduit 1232 when unoperated. The third port of the shuttle valve 1230 is connected by conduit 1234 to the first port of a seven port valve 1236 which has a spring return normally connecting the fourth port of the valve 1236 to its sixth port and normally connecting the fifth port of the valve 1236 to its third port which is connected to the supply. The fifth port of the valve 1236 is connected to a conduit 1238 communicating with the up-down cam position sensing valve 180 which is illustrated functionally as a seven port valve with a spring return normally connecting the third port of the valve 180 to its fifth port and normally connecting the fourth port of the valve 180 to its sixth port which is open to exhaust. In addition, the valve 180 is functionally illustrated as having its pivoted arm 182 engaging a valve moving member 1239 which when depressed operates the valve 180 to connect the third port of the valve 180 to its fourth port and to connect the fifth port of the valve 180 to its seventh port which is open to exhaust; the valve moving member 1239 being similar to the five port valve moving member 974 shown in FIG. 43. The fifth port of the valve 180 is connected by a conduit 1240 to the air switch 916. The fourth port of the valve 180 is connected by a conduit 1242 to an input port of an impulse valve 1244.

The transverse stitch cam valve 186 is normally spring biased closed to exhaust a conduit 1246. The valve operating member 188 when depressed operates the valve 186 to connect the supply to the conduit 1246 which is connected to the second port of the five port valve 1172, the second port of the five port valve 1178, the second port of the seven port valve 1218, the first port of a shuttle valve 1247, the first port of a shuttle valve 1248 and the first port of a shuttle valve 1249. The third port of the air shuttle valve 1247 communicates through a conduit 1250 with the second port of the valve 1122. The air shuttle valve 1248 has a third port connected to a conduit 1252 which communicates with the second port of the seven port valve 1096.

The fourth port of the valve 1172 is connected by a conduit 1256 to the piston advance inputs of the right upper thread cutter air cylinder 409 and the lower right thread cutter air cylinder 664. The fourth port of the valve 1178 is connected by a conduit 1258 to the retract inputs of the air cylinders 409 and 664. The conduit 1256 is also connected to the input port of an impulse valve 1260 which has its output port connected by a conduit 1262 to a first port of a five port valve 1264. The fifth port of the valve 1264 is connected to the supply while the third port of the valve 1264 is connected by a conduit 1266 to the fourth port of the valve 1154 and the air switch 890. The third port of the valve 1154 is connected to the second port of the shuttle valve 1068 by a conduit 1268 which is also connected to the air switch 934.

The output port of the impulse valve 1244 communicates with a conduit 1270 which is connected to the first port of a shuttle valve 1272 which has its third port connected by a conduit 1274 to the second port of the valve 1112.

The fourth port of the seven port valve 1236 is connected by a conduit 1280 to a reset manifold 1282 which is identified in the drawings by an "R" and which is connected to the following: the second port of the second port of the seven port valve 1082, the second port of the seven port valve 1128, the first port of the five port valve 1142, the first port of the five port valve 1172, the first port of the five port valve 1178, the second port of the five port valve 1208, the second port of the shuttle valve 1247, the second port of the shuttle valve 1272 and the fifth port of a five port valve 1284. The third port of the shuttle valve 1249 is connected by a conduit 1285 to the first port of the valve 1284 which has its third port connected by a restricted conduit 1286 to the advance input of the fastener chain feed air cylinder 820. The retract input of the air cylinder 820 is connected by a conduit 1238 to the fifth port of the valve 1236. The conduit 1238 is also connected by a restricted conduit 1288 to the input port of an impulse valve 1290 which has its output port communicating by a conduit 1292 to the second port of the valve 1284. A non-restricted conduit 1294 with a one way valve 1296 is connected in parallel with the restricted conduit 1286 such that when the conduit 1238 is again pressurized after release of the manual reset valve 613 the fastener chain feed air cylinder 820 is allowed to retract slowly to permit the presser foot 87 to descend and grip the fastener chain 68 before the feed member 826 retracts.

The conduit 1238 is also connected to an input port of an impulse valve 1298 which has its output port communicating with a conduit 1300 connected to the second port of the valve 1264.

A manual tape feed valve 1304, connected to the supply, communicates with a conduit 1306 which is connected to a second input of the shuttle valve 1249. The valve 1304 is spring biased to normally exhaust the conduit 1306 until depressed to connect the supply to the conduit 1306.

A manual tape cutting valve 1308 communicates with a conduit 1310 which is connected to a first port of a seven port valve 1312. The valve 1308 is spring biased to normally exhaust the conduit 1310 until depressed to connect the supply to the conduit 1310. The valve 1312 has a spring return normally connecting the third port of the valve 1312 to its fourth port and normally connecting the fourth port of the valve 1312 to its sixth port. The fifth port of the valve 1312 is connected by a conduit 1314 to the input port of an impulse valve 1316 while the fourth port of the valve 1312 is connected by a conduit 1318 to the second port of the shuttle valve 1092. The output port of the impulse valve 1316 communicates with a conduit 1320 connected to the second port of the shuttle valve 1248.

A five port valve 1322 includes the solenoid 938 which when energized operates the valve 1322 to connect its third port to the fourth port of the valve 1322 until air pressure is applied to the first port of the valve 1322 through a conduit 1324 connected to a manual fastener chain fault acknowledge valve 1326 connected to the supply. The valve 1326 is spring biased to normally exhaust the conduit 1324 until depressed to connect the supply to the conduit 1324. The fourth port of the valve 1322 is connected to the supply while the third port of the valve 1322 is connected by a conduit 1328 to the second port of the seven port valve 1236 and to the air switch 940.

Figure 56:
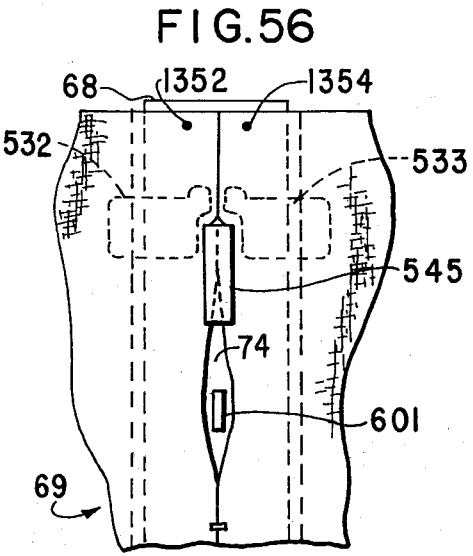
FIG. 56 is a top view of the article of FIG. 3 in the second position and a section of the fastener chain of FIG. 2 in a first position in the apparatus of FIG. 1.
Figure 54:
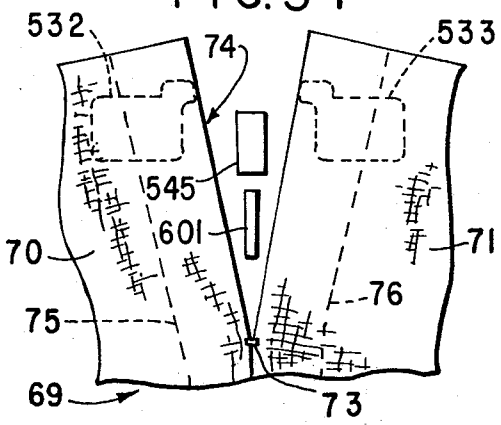
FIG. 54 is a top view of the article of FIG. 3 in a first position in the apparatus of FIG. 1
Figure 55:
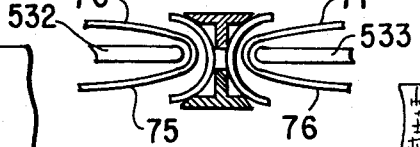
FIG. 55 is a cross section view of the article of FIG. 3 in a second position in the apparatus of FIG. 1.
Figure 57:
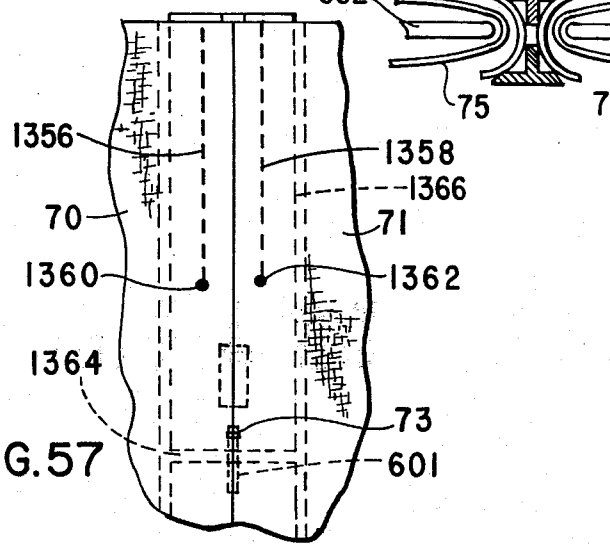
FIG. 57 is a top view of the article of FIG. 3 in a third position and the section of the fastener chain of FIG. 2 in a second position where the section has been severed in the apparatus of FIG. 1.

In operation of the sewing apparatus the article 69 (FIG. 3) is placed by an operator on the cover 81 (FIG. 1), as illustrated in FIG. 54, with the seam allowances 75 and 76 over the inside edges of the open folder plates 532 and 533 and the scroll 545 extending into the opening 74 between the portions 70 and 71. The sewing apparatus is reset by moving the lever arm 614 (FIG. 4) forward and down causing the closing of the folder plates 532 and 533, as shown in FIGS. 55 and 56, and the feeding of the end of the fastener chain 68 beneath the presser foot 87 (FIG. 1) and the needles 93 and 94. The moving of the arm 614 forward also raises the sensing arm 601 to its raised or upright position within the opening 74. Using the knee valve 106 to lift the pressure foot 87, the operator positions the article 69 in position with the edges of the article at points 1352 and 1354 directly beneath the respective needles 93 and 94. Manually depressing the treadle 104 (FIG. 1) operates the sewing machine 64 causing the stitching of parallel line of stitches 1356 and 1358, as shown in FIG. 57, to points 1360 and 1362 where the terminal point 73 engaging the sensing arm 601 rotates the sensing arm 601 and triggers the automatic operation or termination of the sewing operation. Also, the rotation of the sensing arm 601 results in the operation of the fastener chain cutting mechanism 89 (FIG. 4) to sever the fastener chain at 1364 and form the severed section 1366 of fastener chain sewn to the article 69. The operation of the sewing machine 64, under automatic control, continues to sew the lines of stitches 1356 and 1358 from points 1360 and 1362 to points 1368 and 1370 where the machine is automatically stopped by the sensing of the trailing end of the severed section 1366 of fastener chain. Then the left needle 93 is retracted, the upper and lower left threads are cut, and the normal advancing mechanism of the sewing machine 64 is disabled. The transverse camming mechanism 100 and transverse feed mechanism 102 along with the machine 64 are operated so that the garment 69 and the severed section 1366 of the fastener chain are moved to the right as viewed in FIG. 59 to form the transverse line of stitches 1372 and back to the left to form the return line of the stitches 1374 whereupon the machine 64 is stopped. Automatic cutting of the upper and lower right threads and raising the presser foot 67 terminates a cycle of operation of the sewing apparatus.

Figure 61:
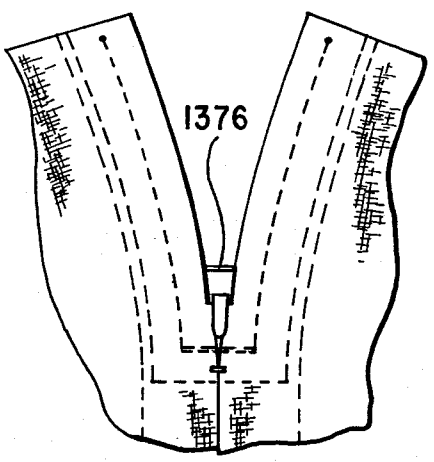
FIG. 61 is a top view of the article of FIG. 3 with the attached severed section of fastener chain of FIG. 2 and an assembled slider.
Figure 60:
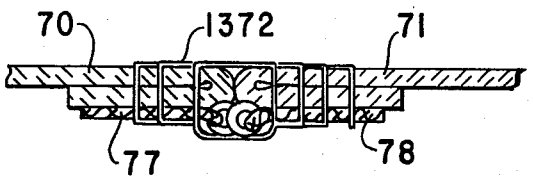
FIG. 60 is a cross section view of the article of FIG. 3 and the severed section fastener chain of FIG. 2 taken along line 60—60 of FIG. 59.
Figure 59:
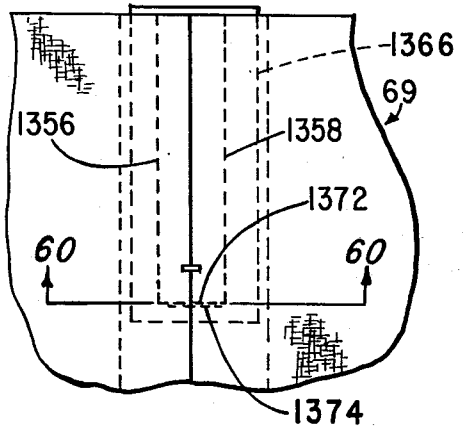
FIG. 59 is a top view of the article of FIG. 3 and the severed section of the fastener of FIG. 2 in the same positions as in FIG. 58 but after transverse feeding and the forming of transverse lines of stitches.

As illustrated in FIGS. 59 and 60 of the lines of stitches 1372 and 1374 joint the portions 70 and 71 of the article and the tapes 77 and 78 of the severed section of fastener chain all together. Thereafter a slider 1376, shown in FIG. 61 is assembled on the fastening elements of the severed section of fastener chain and the article is finished in a suitable manner to form a closable opening in the article. The lines of stitches 1372 and 1374 form the bottom stop for the slider 1376, eliminating the need for metal of plastic bottom stops.

Referring more specifically to the sewing apparatus and to FIGS. 28, 29, 30 and 31, the article is initially positioned in the guiding mechanism 84 with the inner edges of the portions 70 and 71 (FIG. 3) at the opening 74 in the respective channels 566 and 567 of the scroll 545. The folded seam allowances 75 and 76 are positioned to extend beneath the inner edges of the folding plates 532 and 533.

The size of the rear end of the channels 566 and 567 and the amount of extension of the inner edges of the folding plates 532 and 533 into the channels 566 and 567 can be adjusted by turning the screw 587. Turning the screw 587 to advance the screw to the left as viewed in FIG. 31 forces the tapered end 589 between the camming surfaces 590 and 591 of the respective upper and lower clamping members 575 and 576 to slide the upper clamping member 575 upward and to slide the lower clamping member 576 downward within the guideway formed by the block 569, the bifurcations 571 and 572 (FIG. 30) and the plate 573. Upward movement of the horizontal extending portions 579 and 580 (FIG. 29) of the clamping member 575 and downward movement of the horizontal extending portions 583 and 584 of the clamping member 576 allow the free rear ends of the resilient scroll portions 560, 561, 562 and 563 to spread apart increasing the size of the rear ends of the channels 566 and 567. Also the lowering of the member 576 lowers the inclined edges 593 and 595 such that inclined edges 592 and 594 of the respective slide bars 524 and 525 will engage the inclined edges 593 and 595 at greater spaced positions; thus the inner edges of the folding plates 532 and 533 are not allowed to extend as far into the channels 566 and 567. The increase in the size of the rear end of the channels 566 and 567 and the lesser extension of the folding plates 532 and 533 into the channels 566 and 576 allow the channels 566 and 567 to receive and guide articles having material of a greater thickness.

Conversely, turning the screw 587 to retract the tapered end 589 from between the camming surfaces 590 and 591 of the respective clamping members 575 and 576 allows the springs 577 to move the clamping members 575 and 576 toward each other. The inclined edges 581 and 582, 585 and 586 engaging the free ends of the scroll portions 560, 561, 562 and 563 force the rear ends of the scroll portions 560, 561, 562 and 563 together reducing the size of the rear ends of the channels 566 and 567. Also upward movement of the member 576 moves the inclined edges 593 and 595 upward allowing the inclined edged 592 and 594 of the slide bars 524 and 525 to move closer together; thus the inner edges of the folding plates 532 and 533 are allowed to extend further into the channels 566 and 567. Decreasing the size of the channels 566 and 567 and allowing the folding plates 532 and 533 to extend further into the channels 566 and 576 adjusts the capacity of the channels 566 and 567 to accommodate and guide articles having a lesser thickness of material.

Referring to FIG. 4, when the arm 614 is moved to reset the apparatus, the flexible shift 610 is rotated to engage the arm 611 with the valve 613. As shown in FIG. 52 operation of the valve 613 passes pressurized air from the supply manifold 1064 or supply to the second port (see 1029, FIG. 48) of the shuttle valve 1230 shifting its valve member (1014, FIG. 47) to connect the second port of the valve 1230 to its third port (1022, FIG. 47) and conduit 1234. Pressure in conduit 1234 moves the valve member (see 982, FIG. 43) of seven port valve 1236 to connect its third port (998, FIG. 46) to its fourth port (1000) passing supply air to conduit 1280 and reset manifold 1282, and exhausting conduit 1238 through the fifth and seventh ports (1002 and 1006) of the valve 1236. Pressurized air in reset manifold 1282 applied to the first port of valve 1082 moves its valve member connecting the third port (988, FIG. 43) of the valve 1082 to its fifth port (1002) and connecting the fourth port (1000) of valve 1082 to its sixth port (1004), which is open, to apply supply air to conduit 1086 and exhaust conduit 1084 operating the air cylinder 556 and advancing the piston rod 557 to pivot the lever 553 (FIG. 4) and pull the link 548 to the right and push the link 549 to the left to close the folding plates 532 and 533. Exhausting conduit 1084 resets impulse valve 1088.

Air pressure from the reset manifold 1282 through shuttle valve 1247, shown in FIG. 53, and conduit 1250 to the second port of the five port valve 1122 moves its valve member (see 948, FIG. 43) to connect the third port (962) of valve 1122 to its fourth port (964) and to isolate the fifth port (966) of valve 1122 disconnecting the supply from conduit 1126 and exhausting conduit 1126 and the first port of the seven port valve 1128. Air pressure from the reset manifold 1282 on the second port of the valve 1128 operates the valve 1128 to apply supply air to conduit 1132 and to exhaust conduit 1130 operating air cylinders 458 and 480 to retract the piston rod 460 and to advance the piston rod 481. Referring to FIGS. 23 and 24, advancement of the piston rod 481 relative to the air cylinder 480 moves the inclined edge 488 and return portion 487 of the drop feed follower insert 476 into a position between feed lifting cam 483 and the drop feed cam follower 482 lifting the feed dog 86 to a raised position where it will engage an article beneath the presser foot 87 (FIG. 11) when the cam 483 has raised the feed dog 86 to its up position. As illustrated in FIG. 22, retraction of the piston rod 460 rotates the arm 452 and the shaft 450 causing the feed reversing mechanism 440 of the sewing machine 64 when driven by the feed driving eccentric 442 and rotation of the hook driving shaft 444 to oscillate the crank 446 and feed driving rock shaft 448 such that the needles 93 and 94 and the feed dog 86 are moved from front to rear when the needles 93 and 94 are down and the feed dog 86 is in its up position to feed an article through the sewing machine 64.

Referring back to FIGS. 52 and 53, reset air pressure from manifold 1282 is passed through the third and fifth ports of the valve 1284 and the restricted conduit 1286 to the advance input of the fastener chain feeding air cylinder 820 with its retract port exhausting through conduit 1238 to advance the piston rod 822 and the spring advancing member 826 (FIG. 39) to engage the tip 828 with the tapes 77 and 78 of the fastener chain to advance the fastener chain 68 until the leading end of the fastener chain 68 is beneath the presser foot 87 and the needles 93 and 94. The tips 828 do not interfere with the fastener chain 68 being pulled through the fastener chain feeding and guiding mechanism 82 by the rocking feed movement of the feed dog 86 and needles 93 and 94.

Additionally, the air from the reset manifold 1282 is applied to (1) the first ports of valves 1172 and 1178 moving their valve members (see 984, FIG. 44) to connect the third ports (962) of the valves 1172 and 1178 to their fifth ports (966) and isolating the fourth ports (964) of the valves 1172 and 1178 to connect the conduit 1170 to the conduit 1174 and to connect the conduit 1176 to the conduit 1180 to prepare for later operation of the upper and lower left thread cutting mechanisms, (2) the first port of the valve 1142 to enable later retraction of the left needle 93; (3) the second port of valve 1208 to allow later operation of the transverse camming air cylinder 172, and (4 ) the second port of the shuttle valve 1272 applying air through conduit 1274 to the second port of valve 1112 operating the valve 1112 to enable later sensing of the top dead center position of the sewing machine 64.

Exhausting conduit 1238 allows the impulse valves 1290 and 1298 to exhaust their input ports (see 1036 FIG. 51) allowing the springs (1052) of valves 1290 and 1298 to return their large pistons (1046, FIG. 49) to their raised positions, thus resetting the impulse valves 1290 and 1298.

Upon release of the manual reset lever 614 the spring return of the reset valve 613 disconnects the air pressure through the shuttle valve 1230 and exhausts conduit 1232 and 1234 allowing the spring return (see 968, FIG. 43) of the valve 1236 to exhaust conduit 1280 and manifold 1282 and to again connect the supply air to the fifth port of valve 1236 and the conduit 1238. Air pressure from conduit 1238 through the restriction 1288 operates the impulse valve 1298 to apply an impulse of air through conduit 1300 to the second port of the five port valve 1264 which disconnects the supply air pressure from conduit 1266 and exhausts the conduit 1266 to deactuate the air switch 890. Referring to FIG. 42, the air switch 890 returns to its normally closed condition to enable the operation of the motor control circuit 110 and the motor 66. The air switch 894 is maintained closed by air pressure in conduit 1058 (FIG. 52) from the source 1056. Exhausting the air pressure in conduit 1266 (FIG. 53) exhausts conduit 1268 through the valve 1154 closing the air switch 934 along with exhausting the conduit 1070 and the air cylinder 270. When closed the switch 934 (FIG. 42) enables the initiation of a subsequent automatic termination cycle. Exhausting air pressure from the air cylinder 270 allows the presser foot lever 266 (FIG. 6) to pivot causing the presser foot rod 256 (FIG. 16) and presser foot 87 to lower. There after the operator uses the knee lift valve 106 to apply supply pressure through conduit 1066 (FIG. 53) to the first port of the shuttle valve 1068 moving its valve member (see 1014, FIG. 48) to connect the first port (1018) of the valve 1068 to its third port (1022), the conduit 1070 and the air cylinder 270 to raise the presser foot 87 when inserting an article beneath the presser foot 87.

The reapplication of supply air to the conduit 1238 also operates the impulse valve 1290, raising its small piston (1032, FIG. 50) to engage the tapered end (1043) of the small piston with the passageway (1044) in the large piston (1046) passing air pressure through the restriction (1040) and passageways (1042 and 1044) to subsequently force the lowering of both pistons (1044 and 1032, FIG. 51) to apply a pulse of air pressure through the output port (1038, FIG. 50) when the small piston is raised. The pulse of air pressure is applied through conduit 1292 to the second port of valve 1284 to exhaust conduit 1294 and the advance port of the air cylinder 820 through the one way valve 1296 and the valve 1284. The air pressure in conduit 1238 to the retract port of the air cylinder 820 slowly retracts the spring advancing member 826 shown in FIG. 39. The prongs 836 of the spring pawl member 830 and the presser foot 87 engage the tapes 77 and 78 to prevent the fastener chain 68 from being retracted when the advancing member 826 is retracted. The prongs 836 do not interfere with the fastener chain being pulled through the fastener chain feeding and guiding mechanism 82 by the rocking feed movement of the feed dog 86 and needles 93 and 94.

When the operator operates the treadle 104, illustrated in FIG. 42, the treadle switch 874 is closed to energize the motor control circuit 110 from the power terminal 884 through the switch 874, the normally closed contacts 886 of the automatic cycle relay 888, the air switch 890 and the power control terminal 891. The treadle 104 operates the slider of the potentiometer 880 to apply variable control signals from the power terminal 884, through switch 876, contacts 898 and the potentiometer 880 to variable speed terminals 899 of the circuit 110 determining the speed of the motor 66 and the sewing machine 64 to form the parallel line of stitches 1356 and 1358 (FIG. 57).

When the terminal point 73 (FIG. 3) on the article 69 engages the arm 601, (FIG. 4) the arm 601 rotates the shaft 602 and the cam 605, operating the cam follower rod 606 to close the switch 608. In FIG. 42, current through switch 878 closed by the treadle 104 passees through the switch 608 to energize the automatic cycle relay coil 930 along with the valve solenoid 932. Operation of the automatic cycle relay 888 opens normally closed contacts 886 and 898 to terminate manual operation of the motor control circuit 110 and the motor 66 by the treadle 104, and closes normally open contacts 896 and 900 to energize the power control terminal 891 of the motor control circuit 110 from power terminal 884 through switch 892, switch 894, contacts 896 and switch 890: to connect the power terminal 884 to the low speed control terminal 902 of the motor control circuit 110 through contacts 900; and to connect the power terminal 884 through contact 900, contact arm 904 and normally closed contact 908 of the air switch 906 to the high speed control terminal 910, causing operation of the motor 66 at its high speed.

Operation of solenoid 932 operates the valve moving member (see 974, FIG. 43) of the valve 1072 (FIG. 52) to move its valve member to apply supply air pressure to conduit 1076 which passes through valve 1078 and conduit 1080 to the first port of the valve 1082. Since the right end O-ring (see 950, FIG. 44) of the valve 1072 has been removed, the conduit 1074 now exhausts through the first port of valve 1072. Supply air pressure is directed through conduit 1084 from the valve 1082 to the retract port of the air cylinder 556 while conduit 1086 is exhausted to open up the folding plates 532 and 533 (FIG. 4). Pressure in conduit 1084 operates the valve 1078 to disconnect the conduit 1076 from the conduit 1080 and to exhaust the conduit 1080.

As illustrated in FIG. 27, rotation of the arm 601 engages the end 615 of the arm 601 with the projecting portion 616 of the scroll 545 resulting in the terminal point 73 sliding on the edge 617 and raising the article 69 above the scroll 545 as the article 69 continues to be fed between the presser foot 87 and feed dog 86.

Figure 38:
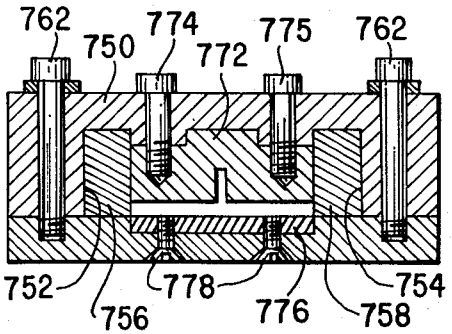
FIG. 38 is a detail cross section view of fastener chain cutting die blocks taken along line 38—38 of FIG. 36.

Air pressure in conduit 1084 (FIG. 52) operates impulse valve 1088 to apply air pulse through conduit 1090 and shuttle valve 1092 to conduit 1094 and the first port of the valve 1096 which operates to apply supply air pressure to the conduit 1098 and to exhaust conduit 1100 advancing the piston rod 796 in the air cylinder 798. As shown in FIGS. 36, 37, 38, the toggle links 786 and 788 are pivoted by the advancement of the piston rod 796 to move the yoke member 760 downward such that the cutting blades 764 and 766 cooperate with the stationary die blocks 772 and 776 to sever the section 1366 (FIG. 57) from the continuous length of fastener chain and to sever the leading portion of the fastener elements from the advancing end of the remaining continuous length of the fastener chain.

Figure 58:
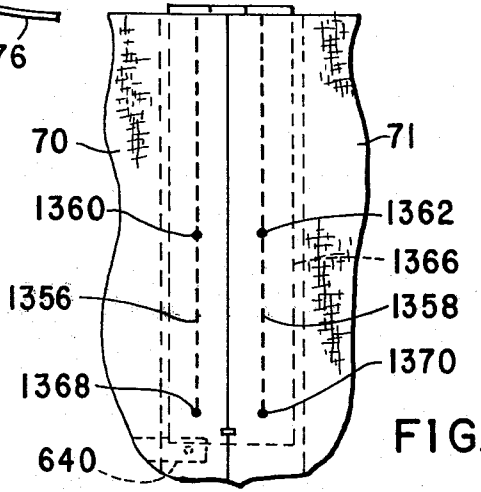
FIG. 58 is a top view of the article of FIG. 3 in a fourth position and the severed section of the fastener chain of FIG. 2 in a third position in the apparatus of FIG. 1.

The air pressure in the conduit 1076 (FIG. 53) is also applied to the first port of valve 1102 to operate the valve 1102 to apply supply air from the non-oil input conduit 1056 to the conduit 1104 and through the restriction 1106 to the upper tube section 640 of the fastener chain end sensing mechanism. When the severed section 1366 of the fastener chain has advanced through the guideway 628 (FIG. 28, 32 and 33) between the plates 620 and 622 such that the trailing end of the severed section passes between the tubular sections 640 and 642 (see also FIG. 58) air from the opening 648 is allowed to pass through the slots 652 and 654 and enter the opening 650 of the tubular section 642. A slight increase in pressure caused in the tubular section 642 is sufficient to operate the booster valve 1108 (FIG. 53) which connects the conduit 1104 to the conduit 1110 operating the air switch 906. Operation of the air switch 906 moves contact arm 904 (FIG. 42) out of engagement with the contact 908 deenergizing the high speed terminal 910 and into engagement with normally open contact 912 to operate the motor 66 at low speed.

Air pressure in the conduit 1110 (FIG. 53) is passed by the valve 1112 to the conduit 1114 to apply air pressure in the tubular section 207. Air from the open end of the tubular section 207 impinges upon the position disc 205 (FIG. 6) mounted on the shaft 122 until the disc 205 reaches the position where the slot 206 is in line with the open ends of the tubular sections 207 and 208, where upon air from the tubular section passes into the tubular section 208. The booster valve 1116 (FIG. 53) is operated by the slight increase in pressure in the tubular section 208 to connect the conduit 1114 to the conduit 1118 operating the valve 1120. Supply pressure is applied by the valve 1120 to the conduit 1124 which opens the air switch 892 and advances the piston 132 in the air cylinder 130 to engage the brake pad 126 (FIG. 5) with the brake disc 112 to stop the sewing machine 64 in its top dead center position with the needles 93 and 94 (FIG. 1) and the thread take up lever 209 in their raised positions. The air pressure in conduit 1118 (FIG. 53) also operates the valve 1122 to connect the supply to conduit 1126, operating the valve 1128 to apply supply air pressure to the conduit 1130 and to exhaust the conduit 1132. The air pressure in conduit 1130 causes the piston rod 460 to advance, rotating the arm 452 (FIG. 22) and the shaft 450 to engage the pivot 462 against the adjustable stop 466 where the reversing mechanism 440 is set at a position which results in substantially zero oscillating movement of the rocker feed drive shaft 448 to eliminate forward and back rock feed motion of the needles 93 and 94 (FIG. 1) and the feed dog 86 (FIG. 24). Also air pressure in conduit 1130 retracts the air cylinder 480 relative to the piston rod 481 removing the return portion 487 from between the cam 483 and cam follower 482 to allow the spring 486 and spring plate 484 to drop the feed dog 86 so that it will not engage the fastener chain beneath the presser foot 87.

Air pressure in the conduit 1126 (FIG. 53) operates impulse valve 1136 producing a pulse of air in conduit 1138. The air pulse is applied through valve 1142 and conduit 1146 to the second port of valve 1148 to connect the source to the conduit 290 and to exhaust the conduit 288 to the air cylinder portion 292 of the left needle retract mechanism. Referring to FIGS. 10, 11, 12 the air pressure in conduit 290 forces the piston 294 upward, pulling the cam 300 and the cam face 338 out of engagement with the ball 306. Upward movement of the cam 300 engages the cam face 340 with the ball 304 urging the ball 304 to the right into engagement with the flat 350 of the detent member 312. The ball 304 is retained against vertical movement within the groove portion formed by the bore 326 (FIG. 13) in the slot 324 of the retractable needle holder 308 and further upward movement of the cam applies upward forces to the ball 304 to move the assembly of the ball 304 and the holder 308 upward, sliding the ball 304 on the flat 350. The engagement of the ball 306 with the bore 358 at surfaces inclined at an angle to the axis of the tubular bar 274 results in the ball being moved to the left from protrusion into the bore 358 to allow the upward movement of the holder 308. Subsequently, the holder 308 reaches the up position of FIG. 12 where the ball 304 is cammed to the right to protrude into the bore 356 locking the holder 308 to the detent bar 312 with needle 93 in a raised inoperative position.

The pulse of air on conduit 1138 (FIG. 53) operates the valve 1140 to connect the conduit 1150 to the supply and to exhaust the conduit 1210. Air pressure in the conduit 1150 operates the air cylinder 500 to advance the piston rod 502 (FIG. 1) and the arm 504 to insert the cam 506 (FIG. 25) behind the tension release lever 508 to release the thread tension mechanism 494. Also the advancement of the piston rod 502 advances the thread slack member 515 (FIG. 1) causing the looped end 516 to pull an additional amount of thread through the thread tension mechanism 494.

Air pressure in the conduit 1150 (FIG. 53) operates the impulse valve 1152 which applies an air pulse through the conduit 1156 to the first port of the valve 1112, disconnecting the conduit 1110 from the conduit 1114 and to exhaust conduit 1114, the tubular sections 207 and 208 and the booster valve 1116.

The pulse of air on conduit 1156 operates the seven port valve 1158 in the logic valve unit 1160 connecting the supply to conduit 1170 and connecting the conduit 1180 to the restricted exhaust line 1183. Air pressure in conduit 1170 is applied through the valve 1172 to the advance ports of the left upper thread cutter air cylinder 390 and the left lower thread cutter air cylinder 662. The retract or exhausting of the air cylinders 390 and 662 are connected through conduit 1176 and the valve 1178 to conduit 1180. Since the exhaust 1183 is restricted, air pressure on the diaphragm of valve 1164 opens the valve 1164, connecting the conduit 1186 to the exhaust 1188 to prevent air from conduit 1170 through the restriction 1184 increasing the air pressure in the conduit 1186.

As illustrated in FIGS. 16, 17, 18 and 19, when the air cylinder 390 is operated the piston rod 392 is advanced to advance the left snagging blades 376 and 380 to push the camming edges 410 into engagement with the thread 414 causing the thread to move to the right until the thread 414 drops into the recess behind the hook portions 418 of the blades 376 and 380. Similarly, the left lower snagging blades 682 and 686 (FIGS. 34 and 35) are advanced by the piston rod 666 (FIG. 4) to hook the left lower thread 732.

Referring back to FIG. 53, when the air piston rods 392 and 366 reach the end of their travel, the exhausting pressure air in the conduit 1180 drops to zero causing the diaphragm valve 1164 to close. Pressurized air entering conduit 1186 through the restriction 1184 from the conduit 1170 then operates the impulse valve 1168, producing an impulse of air on the conduit 1190 which is applied through the delay chamber 1192, after a delay, to the conduit 1194 to the second port of the valve 1158 to connect the supply to conduit 1180 and to connect the conduit 1170 to the restricted exhaust 1182. Air pressure in the conduit 1180 retracts the piston rods 392 and 666, the upper left snagging blades 376 and 380 and the lower left snagging blades 682 and 686.

Figure 20:
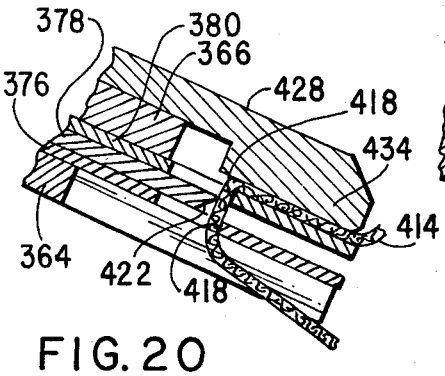
FIG. 20 is a detailed cross section view of the left upper thread cutting and retaining mechanism of FIG. 17 in a fourth position.

As illustrated in FIG. 20, the retraction of the snagging blades 376 and 380 pulls the thread 414 back into engagement with the knife edge 422 of the cutting blade 378. Since the severing edge 422 is sloped backward to the left as shown in FIG. 18, the thread 414 is cammed behind the hook portions 418 preventing the thread 414 from being pushed out of the hook portions 418. Further the slope of the severing edge 422 causes some tearing or sawing action of the thread 414 in addition to subjecting the thread 414 to a shearing action between the upper thread snagging blade 380 and the knife edge 422, thus severing of the thread results even when the severing edge becomes dull through prolonged usage. The lower left thread cutting blades 682 and 686 (FIG. 34) operate in a similar manner to sever the lower thread 722 on the severing edge 730 of the cutting blade 698 with both shearing and sawing action.

Figure 21:
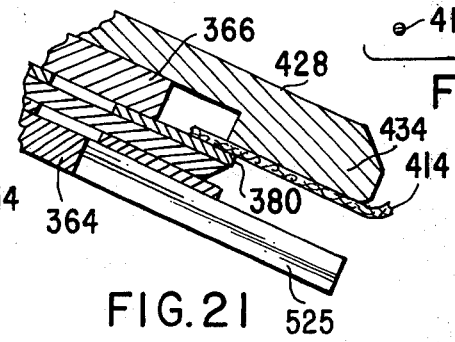
FIG. 21 is a view similar to FIG. 20 illustrating a fifth position of the left upper thread cutting and retaining mechanism.

As shown in FIG. 21, when the upper left snagging blade 380 is fully retracted the severed end of the thread 414 extending from the needle 93 (FIG. 1) is gripped between the thread retaining element 428 under the force of the spring 432 (FIG. 17). Retaining the severed end of the thread along with the slack drawn by the thread slack member 515 prevents subsequent operation of the sewing machine 64 and the movement of the needle 93 from pulling the thread 414 out of the needle 93. The severed end of the thread extending from the article is allowed to fall freely from the cutter through the V-shaped groove 425.

Referring back to FIG. 53, the exhausting air from the advance port of the air cylinders 390 and 662 is passed through conduit 1174, valve 1172, conduit 1170 and valve 1158 to the restricted exhaust 1182. The pressure in conduit 1170 due to the restriction 1182 is sufficient to operate the diaphragm valve 1162 to connect the conduit 1198 to the unrestricted exhaust 1200. After the piston rods 392 and 666 are fully retracted, the pressure within the conduit 1170 drops, closing the valve 1162 and allowing the pressure in conduit 1198 from air passing through restriction 1196 to increase and operate the impulse valve 1166. A pulse of air is produced by impulse valve 1166 on conduit 1202 which is applied to the first port of the valve 1204 connecting the supply to conduit 1206. Pressure in the conduit 1206 operates the valve 1140 to connect the source to conduit 1210 and to exhaust the conduit 1150, resetting impulse valve 1152. The air pressure in conduit 1210 is applied to the retract port of the air cylinder 500 retracting the piston rod 502 (FIG. 1) and the thread slack member 515 leaving the additional amount of thread slack. Also the tension release cam arm 504 is retracted, allowing the thread tension mechanism 494 to apply tension to the threads 414 and 416.

The air pressure in the conduit 1206 (FIG. 53) operates the valve 1120 disconnecting the source from the conduit 1124 and connecting the conduit 1124 to exhaust, which closes the air switch 892 and allows the spring return of the brake air cylinder 130 to retract the brake shoe 126 (FIG. 5) from engagement with the brake disc 112. As shown in FIG. 42, closing the air switch 892 energizes the power control terminal 891 through switch 894, contacts 896 and switch 890 to start the motor 66 in its low speed.

The air pressure in conduit 1206 (FIG. 53) passes through valve 1208 to conduit 1216 operating the valve 1218 to connect the supply to the conduit 1220 and exhaust conduit 1222 operating the air switch 924 and applying air pressure to the retract port of the clutch air cylinder 172. The air pressure in conduit 1220 also operates the valves 1208 and 1142. The valve 1208 disconnects the conduit 1206 from the conduit 1216 so that the valve 1218 can be operated at a later time by air pressure on its second port. Operation of valve 1142 disconnects the conduit 1138 from the conduit 1146 and connects the conduit 1138 to the conduit 1144, thus allowing a subsequent air pulse in the conduit 1138 to operate the valve 1148 to return the needle 93 to its lowered position. As shown in FIG. 42, operation of the air switch 924 operates the contact arm 922 to connect with the normally open contact 928 in preparation for later high speed operation of the motor 66 and sewing machine 64.

Referring to FIG. 7, retraction of the piston rod 174 in the air cylinder 172 applies force through the clevis 176 and the thrust bearing 178 to the cam 158, urging the cam upward into engagement with the pin 154. The pin 154 is not necessarily aligned with one of the holes 156 in the top of the cam 158. Rotation of the projecting portion 152 by the tubular shaft 144, worm wheel 142, worm gear 140, shaft 122, cog pulley 120 (FIG. 5), cog belt 118 and cog pulley 114 slides the pin 154 on the upper surface of the cam 158 until the pin 154 reaches one of the holes 156 where it engages the one hole 156, disengaging the pin 168 from the hole 170. The cam 158 then rotates with the projecting portion 152. Referring to FIG. 6, the cam follower 196 on the arm 197 which is biased by the piston 200 from the air cylinder 201 follows the outer periphery of the cam 158. The arm 197 pivots about point 198 moving the cam follower 222 between the flanges 218 and 220 causing the shaft 210 to follow the movement of the arm 197. As shown in FIG. 9, the bracket 224, the transverse feed plate 226, the block 244, the guide shafts 248, the foot support block 250, the bracket 260 and the presser foot 87 follow the movement of the shaft 210 to produce the transverse lines of stitches 1372 and 1374 (FIG. 59). The large steps 202 and 203 (FIG. 8) prevent breakage of the needle 94 by engagement with the fastener elements 79 and 80 (FIG. 2) of the fastener chain 68. When the cam 158 moves to its up position, the air valve 180 (FIG. 7) is operated by movement of the cam follower roller 184 and the arm 182. As illustrated in FIG. 52, the valve 180 disconnects the conduit 1242 from the conduit 1238 and connects the conduit 1240 and air switch 916 to the conduit 1238. When the air switch 916 is operated, the contact arm 914 (FIG. 42) disengages the contact 918 and engages the normally open contact 920 to connect the power terminal 884 through contacts 900, contact arm 904, contact 912, contact arm 914, contact 920, contact arm 922, and contact 928 to the high speed terminal 910 of the motor control circuit 110 operating the motor 66 at high speed. Also, the valve 180 exhausts the conduit 1242, resetting the impulse valve 1244 in FIG. 53.

At a point determined by the projection 192 (FIG. 7) on the bottom of the cam 158, the air valve 186 is operated by the engagement of the projection 192 with the wheel 190 and the member 188. As illustrated in FIG. 53 operation of the valve 186 connects the supply to conduit 1246 which operates valves 1172, 1178, 1218, 1247, 1248 (FIG. 52) and 1249. The operation of the valves 1172 and 1178 connects the conduits 1170 and 1180 to the respective conduits 1256 and 1258 to prepare for later operation of the right upper and lower thread cutting mechanisms. Operating the valve 1218 connects the supply to conduit 1222 and exhausts conduit 1220, operating the air cylinder 172 to urge advancement of the piston rod 174. Exhausting conduit 1220 deactuates air switch 924 which, as shown in FIG. 42, moves contact arm 922 out of engagement with contact 928 opening the circuit to the high speed terminal 910 to cause the motor 66 to operate at low speed. Referring to FIG. 7, the advancement of the piston rod 174 moves the cam 158 downward into engagement with the pin 168. Since there is only one hole 170 for each complete transverse cycle by the cam 158, the cam will continue to rotate until the hole 170 is aligned with the pin 168 to allow the cam 158 to move downward out of engagement with the pin 154 in position for the next transverse cycle. The operation of the valve 1247 (FIG. 53) applies air pressure to the conduit 1250, operating the valve 1122 to disconnect the supply from conduit 1126 and to exhaust the conduit 1126 resetting the impulse valve 1136. The air pressure operating valve 1248 (FIG. 52) is applied to conduit 1252 operating the valve 1096 to connect the supply to conduit 1100 and to exhaust conduit 1098 retracting the piston rod 796 in the fastener chain cutter air cylinder 798. Referring to FIG. 36, retracting the piston rod 796 results in the raising of the yoke member 760 to raise the cutting blades 764 and 766 away from the die blocks 772 and 776. Operation of the shuttle valve 1249 (FIG. 52) by the valve 196 applies air pressure through conduit 1285 to the first port of valve 1284 operating the valve 1284 to connect the reset manifold to the restricted conduit 1286 to prepare for a subsequent feeding of the fastener chain during the next reset operation.

The air pressure previously applied to the conduit 1210 (FIG. 53) is also applied through a delay chamber 1212 to a conduit 1214 to operate the valve 1204 disconnecting the source from the conduit 1206 and exhausting the conduit 1206 to prepare for the pending restopping of the sewing machine.

When the cam 158 (FIG. 7) moves downward engaging the pin 168 in the hole 170, the air valve 180 is operated to connect the conduit 1242 (FIG. 52) to the conduit 1238 and to exhaust the conduit 1240. Air pressure on conduit 1242 from conduit 1238 operates the impulse valve 1244 (FIG. 53) which applies an air pressure pulse through conduit 1270, shuttle valve 1272 and conduit 1274 to operate the valve 1112 which connects the conduit 1110 to the conduit 1114. When the position disc 205 again aligns the slot 206 (FIG. 6) with the tube sections 207 and 208, the booster valve 1116 is operated to again apply air pressure to conduit 1118 operating the valve 1120 to connect the supply to conduit 1124 and operate the brake air cylinder 130 and the air switch 892 stopping the sewing machine.

Air pressure in the conduit 1118 operates the valve 1122 to connect the supply to conduit 1126 operating the impulse valve 1136. The pulse of air pressure on the output of the valve 1136 is applied through conduit 1138 to the valve 1140 changing the connection of the supply from the conduit 1210 to conduit 1150 and connecting the conduit 1210 to exhaust. The pressure in conduit 1150 operates the air cylinder 500 and the tension releasing mechanism 95 (FIG. 1) to again pull additional thread through the thread tension mechanism 494 (FIG. 25) as previously described. The pressure in conduit 1150 operates the impulse valve 1152 to again produce a pulse of air pressure on conduit 1156 operating the valve 1112 to disconnect conduit 1110 from conduit 1114 and operating the logic valve 1160. The logic valve 1160 alternately applies air pressure through conduits 1170 and 1180 and valves 1172 and 1178 to the respective conduits 1256 and 1258 operating the right hand upper and lower thread cutting air cylinders 409 and 665. Referring to FIG. 16, 18, and 19, the operation of the air cylinder 409 advances and retracts the right upper snagging blades 402 and 404 to snag the thread 416 and to sever the thread 416 with the severing edge 424 of the cutting blade 406 in a manner similar to that previously described for the upper left thread cutting mechanism. The severed end of the thread 416 extending from the needle 94 is held by the thread retaining element 435. Referring to FIGS. 4 and 34, operation of the air cylinder 664 advances and retracts the right lower snagging blades 684 and 688 to sever the thread 724 with the severing edge 732 of the cutting blade 700 in a manner similar to that described for the lower left thread cutting mechanism.

The air pressure in conduit 1150 (FIG. 53) operates the valve 1154 disconnecting the conduit 1266 from the conduit 1268. The air pressure in conduit 1256 from the logic valve 1160 operates the impulse valve 1260 producing a pulse of air in conduit 1262, operating the valve 1264 to connect the source to the conduit 1266 and open switch 890 which, as shown in FIG. 42, disconnects the power terminal 884 from the power control terminal 891 to prevent further operation of the motor 66. When the logic valve 1160 completes its operation it again operates the valve 1204 producing air pressure in conduit 1206 operating the valve 1140 to switch the source from the conduit 1150 to the conduit 1210 and to connect the conduit 1150 to exhaust. Exhausting conduit 1150 allows the valve 1154 to return to its state where the conduit 1266 is connected to the conduit 1268. The air pressure in conduit 1268 from conduit 1266 opens the air switch 934 deenergizing the solenoid 932 (FIG. 42) and the automatic cycle relay coil 930 to open contacts 896 and 900 and to close contacts 886 and 898. Deenergizing the solenoid 932 allows the spring return of valve 1072 (FIG. 52) to connect the source to conduit 1074 operating valve 1078 to connect conduit 1076 to conduit 1080 in preparation for the next cycle. The air pressure in conduit 1268 passes through shuttle valve 1068 and conduit 1070 operating the presser foot air cylinder 270 to raise the presser foot 87 (FIG. 1).

The pulse of air pressure in conduit 1138 passes through valve 1142 and conduit 1144 to the valve 1148 connecting the supply to the conduit 288 and exhausting the conduit 290 to operate the needle retracting air cylinder 292. Referring to FIGS. 11 and 12 air pressure in conduit 288 (FIG. 10) moves the piston rod 296 downward disengaging the cam face 340 from the ball 304 allowing the ball 304 to be disengaged from the bore 356. Continued downward movement of the cam 300 engages the cam face 338 with the ball 306 forcing the ball to the right against the flat 350 whereupon the assembly of the cam 300, ball 306 and retractable needle holder 308 move downward together until the ball 306 reaches the bore 358 where it is forced to project into the bore 358 by the cam face 338 to lock the retractable holder 308 in its lower position.

Linear motors, such as air cylinders, of a size sufficiently small to be contained in a needle bar 274 do not produce sufficient force to maintain a down position when the needle 93 engages an article. The provision of the locking member 306 allows the use of a small linear motor for moving the retractable holder 308. Securing the holder 308 in its down position by the locking member 306 insures that the needles are locked together. When the holder 308 is thus locked it can withstand forces, such as the engagement of the needle 93 with an article, many times as great as the moving force produced by the air cylinder 292.

The air pressure on conduit 1206 (FIG. 53) again operates the valve 1120 to disconnect the supply from the conduit 1124 and to exhaust the conduit 1124 closing the air switch 892 and releasing the brake air cylinder 130. The application of air pressure to conduit 1210 again retracts the tension release piston rod 502 and through delay 1212 operates valve 1204 to disconnect the supply from conduit 1206 and to exhaust conduit 1206. Removing the article with the section of fastener chain sewed thereto, the sewing apparatus is in condition for the initiation of another cycle of operation.

Referring to FIGS. 39, 41 and 42, when the conductive strip 856 is sensed by the contacts 862 and 864 indicating that the fastener chain 68 has a fault therein, the solenoid 938 (FIG. 42) is energized from the power terminal 884. Energization of the solenoid 938 operates the valve 1322 (FIG. 52) connecting the supply to conduit 1328 which prevents the valve 1236 from being operated by air pressure on conduit 1234 from the reset valve 613. Additionally the air pressure in conduit 1328 closes the air switch 940 to energize the indicating lamp 942 (FIG. 42) indicating the presence of the fault in the fastener chain. To allow further operation of the sewing apparatus, the operator depresses the push button valve 1326 which connects the supply to conduit 1324 operating the valve 1322 to disconnect the source from conduit 1328 and connect the conduit 1328 to exhaust. Depressing the manual tape feed push button valve 1304 connects the source to conduit 1306 applying air pressure through shuttle valve 1249 and conduit 1285 to the first port of valve 1284 to connect the reset manifold 1282 to the restricted conduit 1286. Operation of the manual reset valve 613 then applies air pressure through conduit 1232, shuttle valve 1230, conduit 1234 to the valve 1236 connecting the source to conduit 1280 and the reset manifold 1282 to operate the tape feed air cylinder 820 to advance to feed an additional length of the fastener chain. Release of the reset valve 613 results in slow retraction of the air cylinder 820 as previously described. Repeated operation of the tape feed air valve 1304 and the reset valve 613 will feed the fastener chain until the defective portion of the fastener chain has been fed past the fastener chain cutting mechanism 89. Operation of the push button valve 1308 connects the source to the conduit 1310 to operate the air valve 1312 connecting the source to conduit 1318 and applying air pressure through shuttle valve 1092 and conduit 1094 to the first port of the valve 1096. Operation of the valve 1308 also exhausts conduit 1314 resetting the impulse valve 1316. Operation of the valve 1096 connects the source to conduit 1098 and exhausts conduit 1100 to operate the tape cutter air cylinder 798 and cut the fastener chain as previous described. Upon release of the push button valve 1308 the valve 1312 is allowed to return, connecting the source to conduit 1314 to operate the impulse valve 1316. A pulse of air pressure from the impulse valve 1316 is applied through shuttle valve 1248 and conduit 1252 to the second port of the valve 1096, retracting the fastener chain cutting air cylinder 798.

Figure 3:
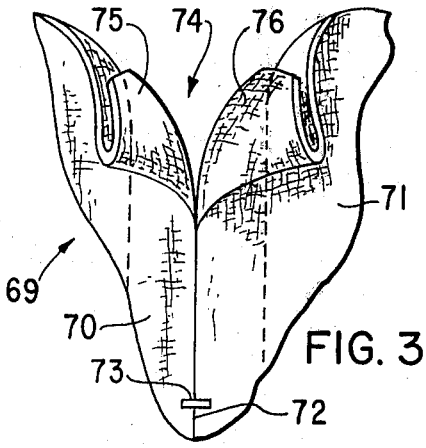
FIG. 3 is a plan view of a broken away portion of an article to which a section of slide fastener chain is to be sewed by the apparatus of FIG. 1.
Figure 63:
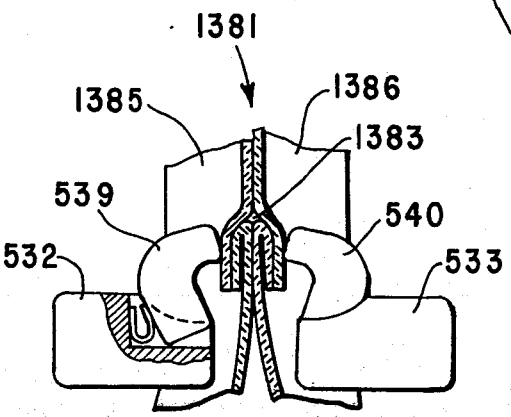
FIG. 63 is a view similar to FIG. 62 but illustrating a second position of the alternate article between the folding plates.
Figure 62:
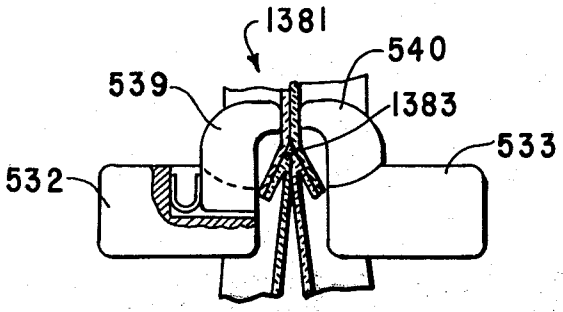
FIG. 62 is a top view with an alternate article between folding plates of the apparatus of FIG. 1.

One particular advantage of the spring biased spring seam closing members 539 and 540 is illustrated in FIGS. 62 and 63. An article indicated generally at 1381 has a transverse seam 1383 which results in folded seam allowances which must pass between the seam closing members 539 and 540. As shown in FIG. 3, the spring biased seam closing members 539 and 540 spread outward, allowing the extra width of article due to the transverse seam 1383 to pass between the members 539 and 540 while maintaining portions 1385 and 1386 of the article 1381 in abutment.

Since many variations, modifications and changes in detail (for example cam control circuits or other alternate forms of electric and/or pneumatic controls, sensing devices, etc.) can be made to the present embodiment it is intended that all matter in the above description and shown in the drawings be interrupted as illustrative and not in a limiting sense.

What is claimed is:

1. An apparatus for sewing an article comprising
- a pair of spaced means each including a needle for forming stitches from a respective thread,
- means for feeding the article longitudinally through the pair of stitch forming means to form a pair of parallel spaced lines of stitches on the article,
- manual control means for initiating operation of the pair of stitch forming means and the feeding means,
- means for sensing a terminal point on the article, and
- means responsive to the sensing means for disabling one of the pair of stitch forming means and the longitudinal feeding means, and
- means responsive to the sensing means for feeding the article transverse to the parallel lines of stitches to form a transverse line of stitches.

2. An apparatus as claimed in claim 1 wherein the transverse feeding means forms a transverse line of stitches extending from one of the parallel lines of stitches toward the other of the parallel lines of stitches.

3. An apparatus as claimed in claim 1 wherein
- one of the pair of stitch forming means includes means for moving its needle between an operative position and an inoperative position; and
- there is included means responsive to the sensing means for operating the needle moving means to move the needle to its inoperative position.

4. An apparatus as claimed in claim 1 including means responsive to the sensing means for severing the thread extending from the needle in the one stitch forming means.

5. An apparatus as claimed in claim 4 which includes means operated after the transverse feeding means for severing the thread extending from the needle in the other stitch forming means.

6. An apparatus as claimed in claim 4 which includes means for holding the severed end of the thread extending from the needle in the one stitch forming means.

7. A double sewing needle mechanism wherein one of the needles is retractable comprising
- an elongated reciprocal support member;
- first means for securing a first needle near one end of the support member;
- second means for securing a second needle, said second means being slidable along the support member from a first position near the one end of the support member to a second position spaced from the one end of the support member;
- a linear reciprocal motor mounted on the support member for moving the second means between the first and second positions; and
- means for locking the second means in the first position.

8. A double sewing needle mechanism as claimed in claim 7 wherein the
- second means is slidable along an axis of the support member; and
- the locking means includes a first recess formed in the support member transverse to the axis, a second recess formed in the second means transverse to the axis, a locking member slidably mounted in the second recess, and camming means moved by the motor for engaging the locking member to urge the locking member both parallel and transverse to the axis to move the second means to the first position where the locking member is urged into the first recess.

9. A double sewing needle mechanism wherein one of the needles is retractable comprising
- a tubular support reciprocable along its axis and having an air cylinder portion toward one end;
- means for securing a first needle near the other end of the support;
- means for securing a second needle, said second needle securing means being slidable along the support axis from a first position near the other end of the support to a second position spaced from the other end toward the one end of the support, and said second needle securing means, having a recess transverse to the support axis;
- a piston slidably movable in the air cylinder portion;
- a piston rod extending from the piston toward the other end of the support;
- detent means in the support having a recess toward the other end of the support, said recess being transverse to the support axis,
- a locking member slidably mounted in the second-needle-securing-means recess; and
- a camming member mounted on the piston rod for engaging the locking member to apply forces both parallel and transverse to the support axis to move the second needle securing means along the support to the first position where the camming member urges the locking member into the detent means recess.

10. A double sewing needle mechanism as claimed in claim 9 wherein the locking member has a end portion formed such that it engages the detent-means recess at an angle inclined to the axis.

11. A double sewing needle mechanism as claimed in claim 10 wherein the end portion of the locking member is rounded, and the detent means has a straight surface adjacent the detent means recess such that the rounded end portion engages the straight surface.

12. A sewing apparatus guide for two opposing folded edges of respective article portions comprising a scroll having a pair of opposed concave surfaces forming channels for receiving the folded edges, a pair of folder plates each having an edge extending into a respective channel of the scroll for guiding the folded edges, a pair of members each for engaging the inside of a respective one of the folded edges, and means mounted on each of the folder plates for biasing each of the members in a direction toward each other.

13. A guide as claimed in claim 12 which includes means for movably mounting the pair of folder plates, and means for moving the edges of the folder plates out of the scroll channels.

14. A sewing apparatus including the guide as claimed in claim 12 and means for sewing a ribbon-like material to the folded portions of the article, wherein the members are spaced such as to guide the folded edges into abutment.

15. A sewing apparatus as claimed in claim 14 wherein the ribbon-like material is a fastener chain having a pair of tapes, and the sewing means includes means for stitching each of the tapes to a respective folded portion of the article.

16. A sewing apparatus as claimed in claim 15 including means for severing a sewn section of a fastener chain from the end of a continuous length of fastener chain.

17. A sewing apparatus guide for a folded edge portion of an article comprising an upper concave scroll portion, a lower concave scroll portion which with the upper scroll portion forms a channel for receiving the folded edge portion, means for adjusting the relative positions between the upper scroll portion and the lower scroll portion to adjust the capacity of the channel, and a folding plate having an edge extending into the channel for guiding the folded edge portion.

18. A sewing apparatus guide as claimed in claim 17 wherein the adjusting means includes camming means for determining the relative positions of the upper and lower scroll portions.

19. A sewing apparatus guide as claimed in claim 17 where the adjusting means includes screw means for determining the relative positions of the upper and lower scroll portions.

20. A sewing apparatus guide as claimed in claim 17 wherein the adjusting means includes camming means for determining the relative positions of the upper and lower scroll portions, and screw means for selectively moving the camming means.

21. A sewing apparatus guide as claimed in claim 17 including means for movably mounting the folding plate, and means for moving the folding plate to move the folding plate edge out of the channel.

22. A sewing apparatus guide as claimed in claim 21 which includes means controlled by the adjusting means for correspondingly adjusting the depth of the extension of the folding plate edge into the channel.

23. A sewing apparatus guide for two opposing folded edge portions comprising a pair of upper opposite concave scroll portions, a pair of lower opposite concave scroll portions, each of the lower scroll portions with a respective upper scroll portion forming a channel for receiving a respective folded edge portion, means for adjusting the relative positions of the upper scroll portions and the lower scroll portions to adjust the capacities of the channels, a pair of folding plates each having an edge extending into a respective one of the channels for guiding the folded edge portions.

24. A sewing apparatus guide as claimed in claim 23 which includes means for slidingly mounting the folding plates and means for moving the folding plates to move the folding plate edges out of the channels.

25. A sewing apparatus guide as claimed in claim 23 wherein the pair of upper scroll portions and the pair of lower scroll portions include respective resilient members, and means for securing the members at one end, the adjusting means includes means engaging non-secured portions of the members for bending the members to adjust the capacities of the channels.

26. A sewing apparatus guide as claimed in claim 25 wherein the adjusting means includes camming means for determining the relative positions of the members, and screw means for selectively moving the camming means; and there is included means for slidingly mounting the folding plates, means for moving the folding plates to move the folding plate edges out of the channels, and means controlled by the adjusting means for correspondingly adjusting the depth of the extension of the folding plate edges into the channels.

* * * * *